US005404842A

United States Patent [19]

Matsushiro et al.

[11] Patent Number: 5,404,842

[45] Date of Patent: Apr. 11, 1995

[54] INTERNAL COMBUSTION ENGINE COOLING APPARATUS

[75] Inventors: Ryuichi Matsushiro, Okazaki; Toshihiko Igashira, Toyokawa; Hiroyuki Fukunaga, Nishio; Yasutoshi Yamanaka, Kariya, all of Japan

[73] Assignee: Nippon Soken, Inc., Nishio, Japan

[21] Appl. No.: 165,882

[22] Filed: Dec. 14, 1993

[30] Foreign Application Priority Data

| | | | |
|---|---|---|---|
| Dec. 15, 1992 | [JP] | Japan | 4-334295 |
| Apr. 26, 1993 | [JP] | Japan | 5-099503 |
| Jul. 23, 1993 | [JP] | Japan | 5-182732 |

[51] Int. Cl.[6] ..... F01P 7/02

[52] U.S. Cl. ..... 123/41.13; 123/41.1

[58] Field of Search ..... 123/41.01, 41.02, 41.1, 123/41.13, 41.29

[56] References Cited

U.S. PATENT DOCUMENTS

| | | | |
|---|---|---|---|
| 4,545,333 | 10/1985 | Nagumo et al. | 123/41.1 |
| 4,759,316 | 7/1988 | Itakura | 123/41.29 |
| 4,964,371 | 10/1990 | Maeda et al. | 123/41.1 |

FOREIGN PATENT DOCUMENTS

| | | |
|---|---|---|
| 60-95126 | 5/1985 | Japan . |
| 1-173415 | 12/1989 | Japan . |
| 4-1413 | 1/1992 | Japan . |

*Primary Examiner*—Noah P. Kamen

*Attorney, Agent, or Firm*—Cushman, Darby & Cushman

[57] ABSTRACT

A cooling apparatus for cooling an internal combustion engine having a coolant passing through the engine is provided. A heat exchanger performs a heat-energy exchange and a heat exchanger bypass passage prevents part of the coolant flowing out from the engine from flowing into the heat exchanger. A coolant combination device forms a mix of coolant which flows in a passage bypassing a thermostat with coolant which flows in a passage through the thermostat, while a flow rate ratio adjusting valve continuously adjusts the ratio of the flow rate of the part of the coolant which bypasses the thermostat to the part of the coolant which passes through the thermostat in accordance with a temperature of the coolant. Accordingly, the higher the temperature is, the larger the ratio is. Moreover, the temperature is controlled in accordance with a load of the engine so that the larger the load is, the higher the temperature is.

20 Claims, 16 Drawing Sheets

CO2
(%)
18
15
12
9
6
3
0
PRESENT INVENTION
PRIOR ART
FEED-BACK
CONDITION

CO
(%)
8
6
4
2
0
PRIOR ART
FEED-BACK
CONDITION
PRESENT
INVENTION

THC
x10²
(ppm)
5
4
3
2
1
0
PRESENT INVENTION
PRIOR ART
0
0.5
1
1.5
2
2.5
3
ELAPSED TIME FROM ENGINE START (min)

$(P_1 - P_2) \propto Ne$

INTERNAL COMBUSTION ENGINE COOLING APPARATUS

BACKGROUND OF THE INVENTION AND RELATED ART STATEMENT

The present invention relates to an internal combustion engine cooling apparatus in which a temperature of a coolant is controlled.

In a conventional internal combustion engine cooling apparatus, the temperature of the coolant is kept substantially constant by a thermostat valve.

OBJECT AND SUMMARY OF THE INVENTION

An object of the present invention is to provide an internal combustion engine cooling apparatus in which the temperature of the coolant is controlled in accordance with a variation of actual engine load or desired output power.

According to the present invention, a cooling apparatus for cooling an internal combustion engine with a coolant passing through the engine, comprises a heat exchanger and a coolant path between the engine and the heat exchanger. A first bypass arranged in parallel with the coolant path so that the coolant from the engine bypasses the heat exchanger. A flow rate control valve is arranged between the first bypass passage and the coolant path at the downstream side, and a ratio between a flow rate through the coolant path and a flow rate through the first bypass passage is adjusted in accordance with a measured temperature of the coolant. A pump circulates the coolant. A load condition of the engine is measured. A second bypass passage diverges from the first bypass passage and joins the coolant path between the flow rate control valve and the engine. A flow rate adjusting valve is arranged between the first and second bypass passages and makes the flow rate through the first bypass passage smaller than a flow rate through the second bypass passage when the measured load condition is lower than a predetermined load condition, and makes the flow rate through the first bypass passage larger than the flow rate through the second bypass passage when the measured load condition is higher than the predetermined load condition.

The load condition may be measured from a vacuum pressure in an intake tube for supplying a fuel/air mixture into the engine so that the flow rate adjusting valve adjusts a ratio between the flow rate through the first bypass and the flow rate through the second bypass in accordance with the vacuum pressure.

The cooling apparatus may also comprise a third bypass for connecting an outlet side of the engine and a downstream side of an intake air side preferential cooling path of the engine to allow the coolant to flow in the third bypass when a temperature of the coolant is not larger than a predetermined temperature. The cooling apparatus may comprise a coolant temperature measuring means for measuring a temperature of the coolant, and the flow rate adjusting valve makes the flow rate through the first bypass larger than the flow rate through the second bypass when the measured temperature is not lower than a predetermined temperature.

The temperature of the cooling water is controlled in accordance with a load of the engine so that the larger the load is, the higher the temperature of the cooling water becomes.

The flow rate can be adjusted to allow at least a portion of the part of coolant flowing out from the heat exchanger means and at least a portion of the another part of coolant bypassing the heat exchanger means. A temperature of the flow rate ratio adjusting means is influenced by an intermediate temperature between a temperature of one part of the coolant and a temperature of another part of the coolant. Therefore, the temperature can be changed quickly by the partial flow, and is controlled according to the load of the engine, so that the ratio of the flow rate of the part of the coolant to flow rate of the other part of the coolant is adjusted quickly according to the load of the engine.

The cooling apparatus may comprise a supplemental heat exchanger bypass means for preventing a remaining part of the coolant flowing out from the engine from flowing into the heat exchanger means and from flowing into the heat exchanger bypass means so that the remainder part of the coolant returns into the engine after bypassing the heat exchanger means and the heat exchanger bypass means. The temperature may be controlled by changing a flow rate of the other part of the coolant. The load of the engine may be measured from a vacuum pressure of an intake air supplied to the engine. The cooling may comprise a supplemental heat exchanger bypass means for preventing a remainder part of coolant flowing out from the engine from flowing into heat exchanger means and from flowing into heat exchanger bypass means so that the remainder part of the coolant returns into the engine after having bypassed the heat exchanger means and the heat exchanger bypass means, and a total amount of the flow rates through the heat exchanger bypass means and the supplemental heat exchanger bypass means may be kept substantially constant so that the larger the flow rate of one part of the coolant is, the smaller a flow rate of the remainder part of the coolant. The load of the engine may be measured from an engine output power instructing signal, for example, an operated angle of an accelerator pedal. The ratio may be adjusted by changing a flow rate of the part of the coolant. The temperature controlling means may be an electric heater for controlling the temperature of the part of the flow rate ratio adjusting means. The electric heater may be arranged directly on the flow rate ratio adjusting means.

The cooling apparatus may comprise an intake air heating means for heating an intake air for the engine by a heat energy exchange between the intake air and at least a portion of the coolant which bypasses the heat exchanger means and flows through the intake air heating means. The cooling apparatus may comprise an intake-port-side cylinder-head-part bypassing means for allowing at least a portion of the coolant to bypass an intake-port-side cylinder-head-part of the engine so that an intake air is restrained from being cooled in the intake-port-side cylinder-head-part by the portion of the coolant when the load of the engine is smaller than a predetermined load. The cooling apparatus may comprise an intake port-side cylinder-head-part bypassing means for allowing at least a portion of the coolant to bypass an intake-port-side cylinder-head-part of the engine so that an intake air is restrained from being cooled in the intake-port-side cylinder-head-part by the portion of the coolant when a temperature of the coolant supplied into the engine is smaller than a predetermined temperature.

The temperature controlling means may increase the temperature when a temperature of the coolant supplied into the engine is higher than a desirable temperature.

The load of the engine may be calculated from an engine throttle opening degree and an engine output rotational speed. The temperature controlling means may increase the temperature when a knocking occurs in the engine. The temperature controlling means may control the temperature in accordance with a difference in crank-shaft angular position between an actual ignition timing and a desirable ignition timing.

DESCRIPTION OF PREFERRED EMBODIMENTS

Description will be given below of a cooling system of an internal combustion engine according to preferred embodiments of the present invention with reference to the drawings.

Figure 1:
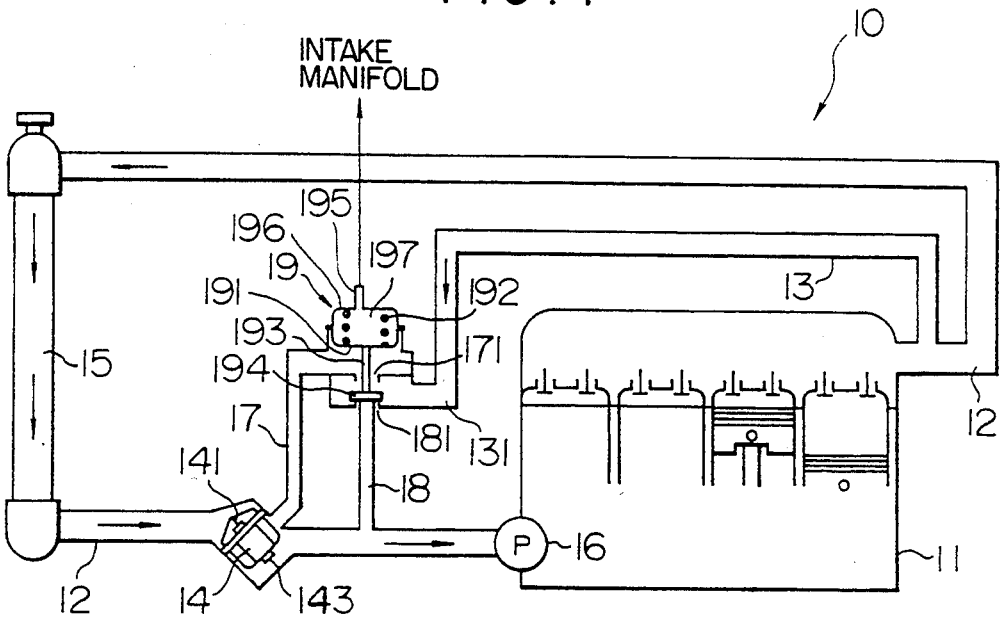
FIG. 1 is a structural view of a cooling system of an internal combustion engine according to a first embodiment of the present invention.

FIG. 1 is a structural view showing an arrangement of a first embodiment.

A cooling system 10 of an internal combustion engine according to the present invention comprises, as shown in FIG. 1, an engine 11 as an internal combustion engine, a cooling water passage 12 connected between the engine 11 and a radiator 15 serving as a heat exchanger for radiating heat, a bypass flow passage 13 disposed in parallel with the cooling water passage 12 and bypassing the radiator 15, a thermostat 14 disposed at an intermediate point in the cooling water passage 12 and serving as a flow rate control valve which controls the distribution of flow rates in the cooling water passage 12 and in the bypass flow passage 13 in accordance with the temperature, a pump 16 for circulating cooling water, and a flow rate regulating valve 19 which serves to allow cooling water to flow from the bypass flow passage 13 to a first passage 17 forming a part of the bypass flow passage 13 or to a second passage 18 corresponding to a second bypass flow passage.

The flow rate regulating valve 19 is disposed in a downstream portion 131 of the bypass flow passage 13. In the flow rate regulating valve 19, a diaphragm chamber 197 is formed between a casing 196 and a diaphragm 191, and a compression spring 192 is also disposed between the casing 196 and the diaphragm 191. The diaphragm 191 is provided at the lower portion thereof with a cylindrical driving force transmission portion 193 and a valve body 194 which is provided at an end portion of the driving force transmission portion 193 and serves to control the opening areas of a communication hole 171 through which the bypass flow passage 13 and the first passage 17 are communicated with each other and of a communication hole 181 through which the bypass flow passage 13 and the second passage 18 are communicated with each other. The diaphragm chamber 197 is communicated with an intake pipe, particularly within a surge tank (referred to as intake manifold hereinafter, although not shown), so that the valve body 194 is moved up and down depending on the balance between the negative pressure of the intake manifold and the reaction force of the compression spring.

The first passage 17 is arranged between the flow rate regulating valve 19 and the thermostat 14 so that the cooling water coming from the bypass flow passage 13 into the first passage 17 is made to come in contact with a temperature sensing portion of the thermostat 14 which serves to increase and decrease the throttle opening area for the cooling water passing through the cooling water passage 12 in accordance with the increase and decrease of the temperature of the temperature sensing portion. The cooling water passing through the cooling water passage 12 also comes in contact with the temperature sensing portion. However, the temperature of the temperature sensing portion is adjusted mainly in accordance with the flow rate of the cooling water passing through the first passage 17.

On the other hand, the second passage 18 is arranged between the flow rate regulating valve 19 and the cooling water passage 12 extending between the thermostat 14 and the pump 16, so that the cooling water coming from the bypass flow passage 13 into the second passage 18 flows into the pump 16 without passing the thermostat 14 and therefore without coming in contact with the temperature sensing portion of the thermostat 14.

Next, the operation of the present embodiment will be described.

At the time of the operation of the engine 11 under a low-load condition, since the negative pressure of the intake manifold is large (or the absolute pressure is small), a large negative pressure (or a small absolute pressure) is applied within the diaphragm chamber 197 of the flow rate regulating valve 19. When a negative pressure larger than a specified pressure (or an absolute pressure than a specified absolute pressure) is applied within the diaphragm chamber 197 (to make smaller the absolute pressure in the diaphragm chamber 197 smaller), the valve body 194 is moved up against the spring 192.

As a result, the major part of the cooling water passing through the bypass flow passage 13 is allowed to pass through the second passage 18 and is then drawn into the pump 16 so as to be returned into the engine 11. Since the cooling water passed through the second passage 18 does not come in contact with the temperature sensing portion of the thermostat 14, the thermostat 14 is stabilized in its valve closing position so as to make the throttle opening area for the flow of the cooling water passing through the 13 radiator 15 smaller. Consequencially, the cooling water is maintained at high temperatures.

On the other hand, when the engine 11 is not operated under a low-load condition but rather is under a high-load condition, since the negative pressure of the intake manifold decreases (or the absolute pressure becomes large), the negative pressure of the intake manifold becomes lower than the specified pressure so as to cause the valve 194 to move down, and accordingly, the major part of the cooling water passing through the bypass flow passage 13 is allowed to pass through the first passage 17 to come in contact with the temperature sensing portion of the thermostat 14, and thereafter, is drawn by the pump 16.

As a result, since the high-temperature cooling water in the bypass flow passage 13 comes in contact with the temperature sensing portion of the thermostat 14, the thermostat 14 is stabilized in its valve opening position so as to increase the throttle opening area for the flow of the cooling water passing through the radiator 15, with the result being that the cooling water is maintained at low temperatures.

Incidentally, the flow rate regulating valve 19 can change continuously the distribution of the flow rates of cooling water passing through the first and second passage 17 and 18 in accordance with the negative pressure of the intake manifold so that, when the load is changed from low to high or from high to low, it is possible to change the set temperature of water smoothly from high to low or from low to high, and accordingly, there is no possibility that the durability of the engine 11 is deteriorated.

Next, a description will be given of a second embodiment of the present invention.

Figure 2:
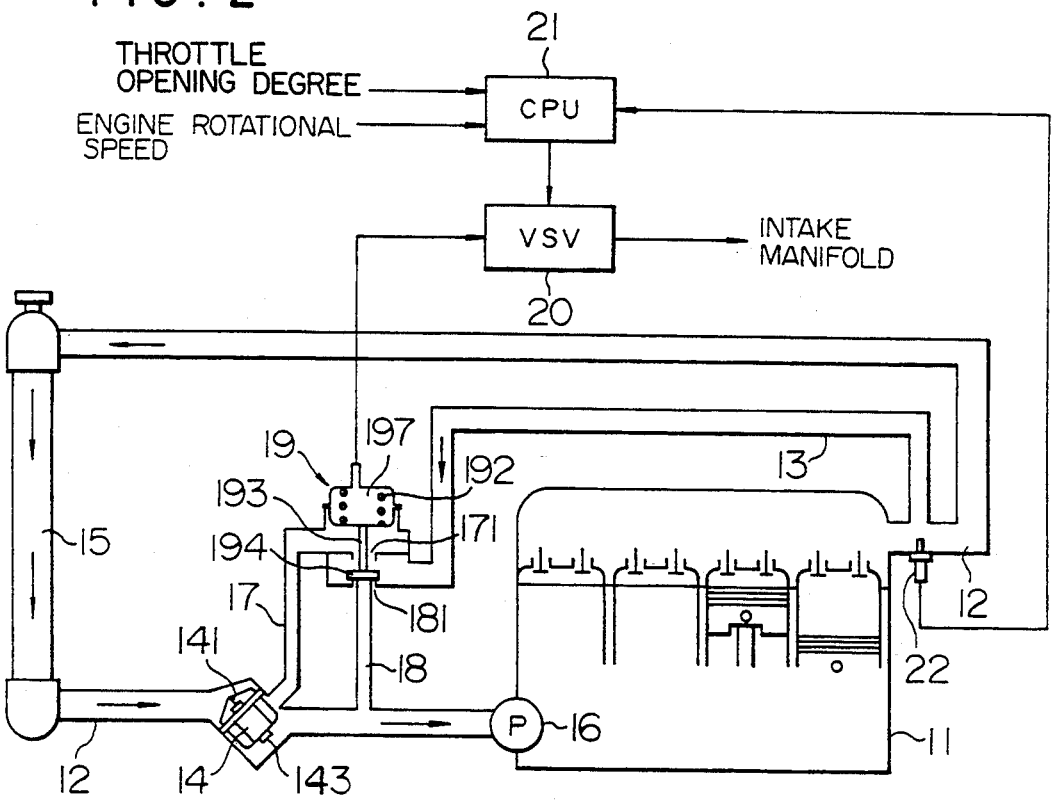
FIG. 2 is a structural view of a cooling system of an internal combustion engine according to a second embodiment of the present invention.

FIG. 2 is a structural view showing an arrangement of the present embodiment.

In the arrangement of the first embodiment described above, a VSV (vacuum switching valve) 20 is disposed at an intermediate point in the pipeline connecting between the inside of the diaphragm chamber 197 of the flow rate regulating valve 19 and the intake manifold, and it is driven under the control of a CPU 21 which is an arithmetic processing unit. The CPU 21 receives an output from a water temperature sensor 22 which detects the temperature of the cooling water discharged from the engine 11 and further receives a throttle opening degree and an engine rotational frequency.

A controlling method of the CPU 21 will be described with reference to a flow chart shown in FIG. 7.

Figure 7:
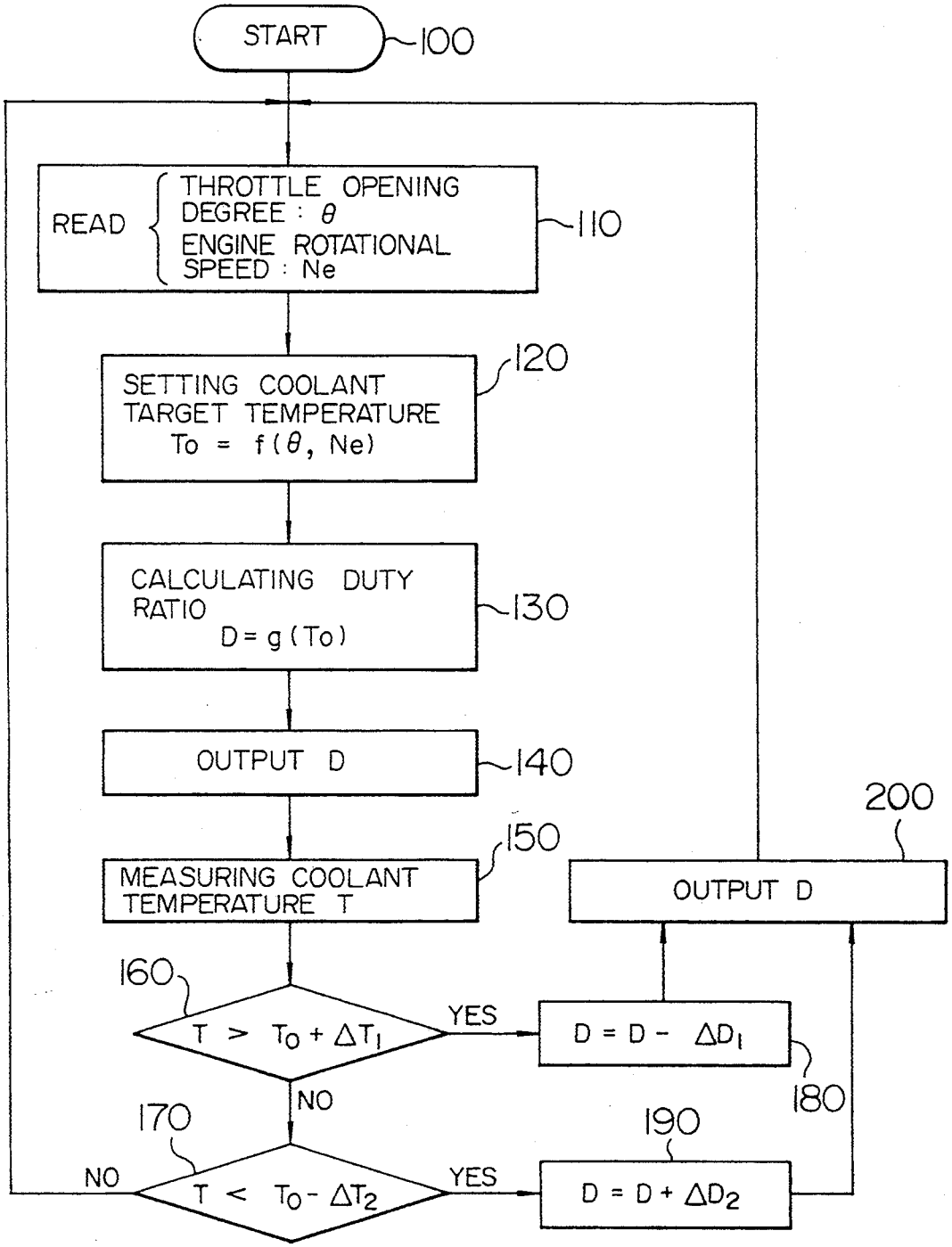
FIG. 7 is a flow chart showing the progress of control in the control unit used in the second embodiment of the present invention.

As an ignition for starting the engine 11 is turned on, the CPU 21 starts controlling at step 100 as shown in FIG. 7.

Subsequently, at step 110, a throttle opening degree and an engine rotational frequency Ne are read. At step 120, a desired water temperature $T_0$ of the cooling water is set on the basis of the throttle opening degree 0 and the engine rotational frequency Ne read at step 110. In setting the desired water temperature $T_0$, it may be calculated as a function $f$ of $\theta$ and Ne or obtained from a map of $T_0(\theta, Ne)$ prepared beforehand through a proportional calculation or the like.

At succeeding step 130, a duty ratio D representing the opening degree of the VSV 20 disposed between the intake manifold and the diaphragm chamber 197 is calculated. In calculating the duty ratio D, it may be calculated as a function g of the desired water temperature $T_0$ or obtained from a map $D(T_0)$ prepared beforehand relative to the desired water temperature $T_0$ through a proportional calculation or the like.

Incidentally, the greater the duty ratio D the more exactly the negative pressure of the intake manifold is transmitted to the diaphragm chamber 197, and accordingly, the negative pressure of the diaphragm chamber 197 becomes large. If the negative pressure in the diaphragm chamber 197 becomes large, it becomes possible to draw up the valve body 194. As a result, the cooling water is guided to the second passage 18 so that the water temperature is raised.

At step 140, the duty ratio D calculated at step 130 is delivered to the VSV 20 so as to control the opening degree of the VSV 20.

At succeeding step 150, a cooling water temperature T is detected by the water temperature sensor 22.

At step 160, the cooling water temperature T detected at step 150 is compared with a temperature ($T_0+\triangle T1$) obtained by adding a specified differential temperature AT1 to the desired water temperature $T_0$. When the actual cooling water temperature T is higher than the temperature ($T_0+\triangle T1$), the actual cooling water temperature T has reached a temperature which is higher than the desired water temperature $T_0$ by an amount equal to the specified temperature $\triangle$ T1 or more. Accordingly, it is decided that the actual cooling water temperature T is not controlled to be within a specified range of the desired water temperature $T_0$ and therefore it is required that it be corrected. That is, with the result of "YES" to step 160, the procedure proceeds to step 180.

At step 160, if the cooling water temperature T is lower than the temperature ($T_0+\triangle T1$), step 160 results in "NO", and accordingly, the process proceeds to step 170.

At step 170, the cooling water temperature T detected at step 150 is compared with a temperature ($T_0-\triangle T2$) obtained by subtracting a specified temperature $\triangle$ T2 from the desired water temperature $T_0$. When the actual cooling water temperature T is higher than the temperature ($T_0-\triangle T_1$), it is decided that the cooling water temperature T is controlled to a range within the desired water temperature $T_0$ and requires no correction, and accordingly, the procedure returns to step 110.

When the cooling water temperature T is lower than the temperature ($T_0 - \triangle T2$), the cooling water temperature T reaches a temperature which is lower than the desired water temperature $T_2$ by the specified temperature $\triangle T_2$ or more. Accordingly, it is decided that the cooling water temperature T is not controlled to within a desired range of the water temperature $T_0$ and therefore it is required that it be corrected. Therefore, with a result of "YES", the procedure proceeds to step 190.

When it is decided at step 160 that the cooling water temperature T is controlled to a temperature which is higher than the desired range of water temperature $T_0 + \blacktriangle T2$, the procedure proceeds to step 180. Accordingly, at step 180, in order to lower the cooling water temperature T, a new duty ratio D is calculated by subtracting a specified duty ratio AD1 from the duty ratio D calculated at step 130.

As the duty ratio D is made small by subtracting the specified duty ratio $\triangle D_1$ from the duty ratio D calculated at step 130, the opening degree of the VSV 20 becomes small and, accordingly, the negative pressure of the intake manifold which is to be transmitted to the diaphragm chamber 197 is reduced. As the negative pressure of the intake manifold applied to the diaphragm chamber 197 is reduced, the valve body 194 is moved in such a direction as to close the communication hole 181 but open the communication hole 171, and accordingly, the cooling water of high temperature comes in contact with the temperature sensing portion of the thermostat 14 so that the flow rate ratio of the cooling water flowing through the radiator 15 is increased. As a result, the water temperature is lowered.

On the other hand, when it is decided at step 170 that the cooling water temperature T reaches a temperature which is lower than the desired water temperature $T_0$ by the specified temperature AT2 or more, the procedure proceeds to step 190. In this case, at step 190, in order to raise the cooling water temperature T, a new duty ratio D is calculated by adding a specified duty ratio $\triangle D_2$ to the duty ratio calculated at step 130. As the duty ratio becomes large, the opening degree of the VSV 20 becomes large and, accordingly, the negative pressure of the intake manifold is transmitted into the diaphragm chamber 197. Then, the valve body 194 is moved up to make the cooling water flow into the second passage 18 without the temperature of the cooling water being substantially transmitted to the thermostat 14. Accordingly, if the duty ratio becomes large the temperature of the cooling water is increased.

Subsequently, at step 200, the duty ratio D newly calculated at above step 180 or 190 is delivered to the VSV 20. Thereafter, the process proceeds to step 110.

By repeating the above procedure in accordance with the flow chart, the control of the temperature is performed.

With the system of such arrangement, it is possible to control the water temperature delicately in conformity with the running conditions at that time.

Further, because the CPU 21 receives information on the property, condition and kind of the fuel, e.g., regular or high-octane, or, methanol or gas oil, it is also possible to control the water temperature in conformity with the property, condition and kind of fuel by making the CPU 21 transform the function $f$ or the map of $T_0(\theta, Ne)$ used for obtaining the desired water temperature $T_0$ or read the function or map stored beforehand separately for every kind of fuel in accordance with the respective properties and conditions. Incidentally, as means for giving the information on the property, condition and kind of the fuel to the CPU 21, a sensor may be used or an operator may give an instruction using a changeover switch or the like.

Figure 9:
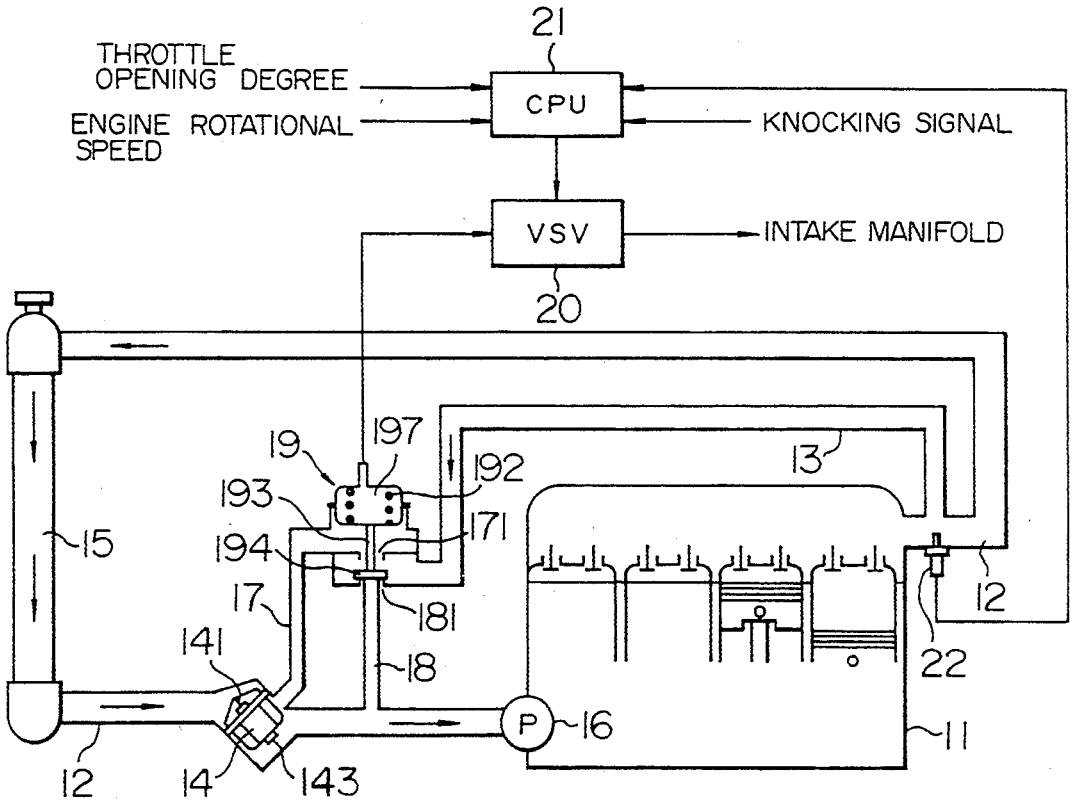
FIG. 9 is a structural view of another embodiment of the present invention.

Moreover, by employing an arrangement shown in FIG. 9 in which a knock signal is added as the input signal to the CPU 21 shown in FIG. 2, it is possible to control the water temperature more delicately since it becomes possible to decide whether or not knocking will occur. Namely, it is possible to realize the best water temperature control which is capable of coping not only with the running conditions of the engine 11 but also with the environmental conditions including the atmospheric pressure and atmospheric temperature. Further, this controlling method is effective even in case of supercharging as in an engine with a turbosupercharger.

Next, with the arrangement as shown in FIG. 9, a controlling method of the CPU 21 will be described in conformity with a flow chart shown in FIG. 10.

From step 100 to step 200, control is performed in the same manner as that of FIG. 7. At step 210, when a knock signal is "present", it is considered that knocking is being caused since the intake pressure is high or the intake temperature is high. Accordingly, the knock is controlled by further lowering the water temperature. At step 220, the duty ratio is newly calculated by subtracting a specified duty ratio AD3. Then, at step 230, the new duty ratio is delivered to the VSV 20, and the procedure returns to step 110. Meanwhile, when the knock signal is "absent" at step 210, the procedure returns to step 110. Further, when step 170 results in a "NO", the procedure proceeds to step 210 at which it is decided whether the knock signal is present or absent.

Particularly when it is decided that a dangerous condition exists because the cooling water temperature becomes too high, the negative pressure of the intake manifold will be reduced by the VSV 20. By reducing the negative pressure of the intake manifold, the force with which the spring 192 depresses the diaphragm 193 becomes stronger so that the valve body 194 is moved down to allow the cooling water to flow through the first passage 17. In this way, the cooling water of high temperature is made to flow toward the temperature sensing portion of the thermostat 14 and, therefore, the thermostat 14 is stabilized in its valve opening position so as to increase the flow rate ratio of the cooling water subjected to heat exchange by the radiator 15. As a result, the water temperature is lowered, and hence, it is possible to prevent the occurrence of the dangerous condition such as overheating of the engine 11.

Incidentally, in the present embodiment, the negative pressure of the intake manifold is applied to the diaphragm chamber 197. However, this design is not limited as such and the loaded condition of the engine may be detected by other means such as by the throttle opening degree or the engine rotational frequency by connecting to a vacuum tank which can impart a specified negative pressure.

Next, other structures of the flow rate regulating valve 19 are shown in FIGS. 3, 11, 14A and 14B.

Figure 3:
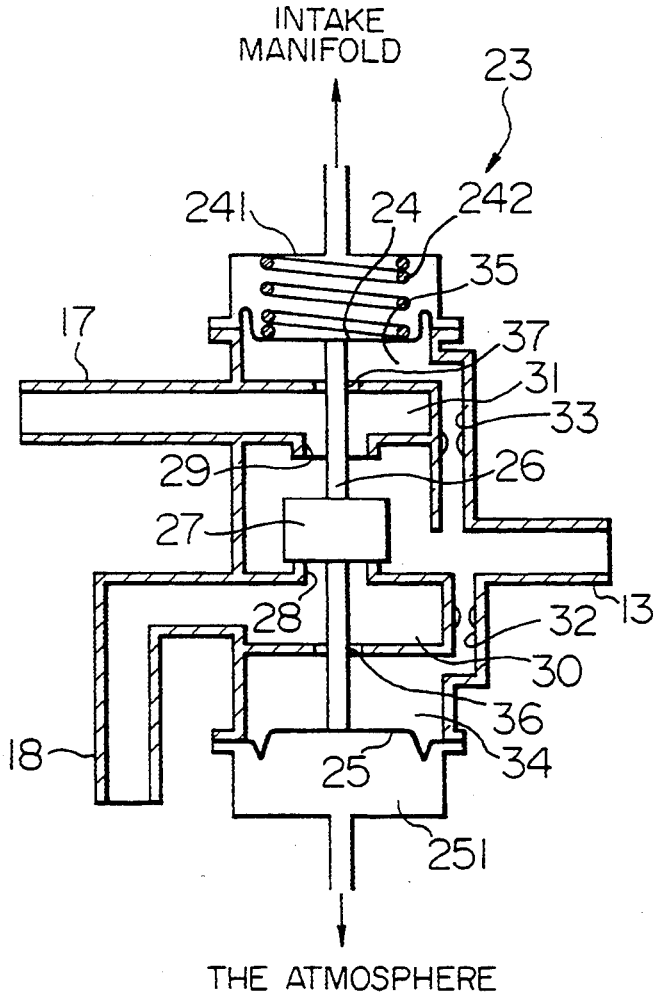
FIG. 3 is a sectional view showing essential portions of a modification of the flow rate regulating valve.

In a flow rate regulating valve 23 shown in FIG. 3, diaphragms 24, 25 are actuators stuck to the opposite ends of a shaft 26, and a valve body 27 is provided at an intermediate portion of the shaft 26. An upper space 241 formed above the diaphragm 24 in the drawing is connected to the intake manifold so that the negative pressure of the intake manifold is applied to the diaphragm 24. Within the upper space 241 is disposed a spring 242 serving to depress the diaphragm 24 downwards in the drawing. Meanwhile, a lower space 251 formed below the diaphragm 25 in the drawing is opened into the air.

At the time of operation of the engine 11 under a low-load condition, the negative pressure of the intake manifold is large so that a large suction force is exerted on the diaphragm 24. When the suction force resulting from the negative pressure is larger than the depressing force of the spring 242, the valve body 27 is drawn up together with the diaphragm 24. As a result, the major part of the cooling water coming from the bypass flow passage 13 enters into a chamber 30 through a communication hole 28 and then flows through the second passage 18 into the engine 11 without passing through the thermostat 14. Accordingly, the water temperature is raised.

On the otherhand, at the time of operation of the engine 11 under a high-load condition, the valve body 27 is moved in such a direction as to close the communication hole 28 since the negative pressure of the intake manifold is small. Accordingly, the major part of the cooling water coming from the bypass flow passage 13 enters into a chamber 31 through a communication hole 29 and then flows through the first passage 17. As a result, the cooling water having a high temperature is made to come in contact with the thermostat 14 so that the flow rate ratio of the cooling water passing through the radiator 15 is increased by the thermostat 14. Consequentially, the water temperature is lowered.

Meanwhile, part of the cooling water coming from the bypass flow passage 13 is made to flow into diaphragm adjoining chambers 34, 35 through throttle passages 32, 33 so as to constantly flow into the second and first passages 18, 17 through gaps 36, 37, respectively. Accordingly, the water pressures of the diaphragm adjoining chambers 34, 35 are equal to each other at all times so that the pushing-up force applied to the diaphragm 24 corresponding to the water pressure is canceled by the depressing force applied to the diaphragm 25 owing to the water pressure. As a result, the movement of the valve body 27 which is associated with the diaphragm actuator can be controlled by only the negative pressure of the intake manifold.

Figure 14A:
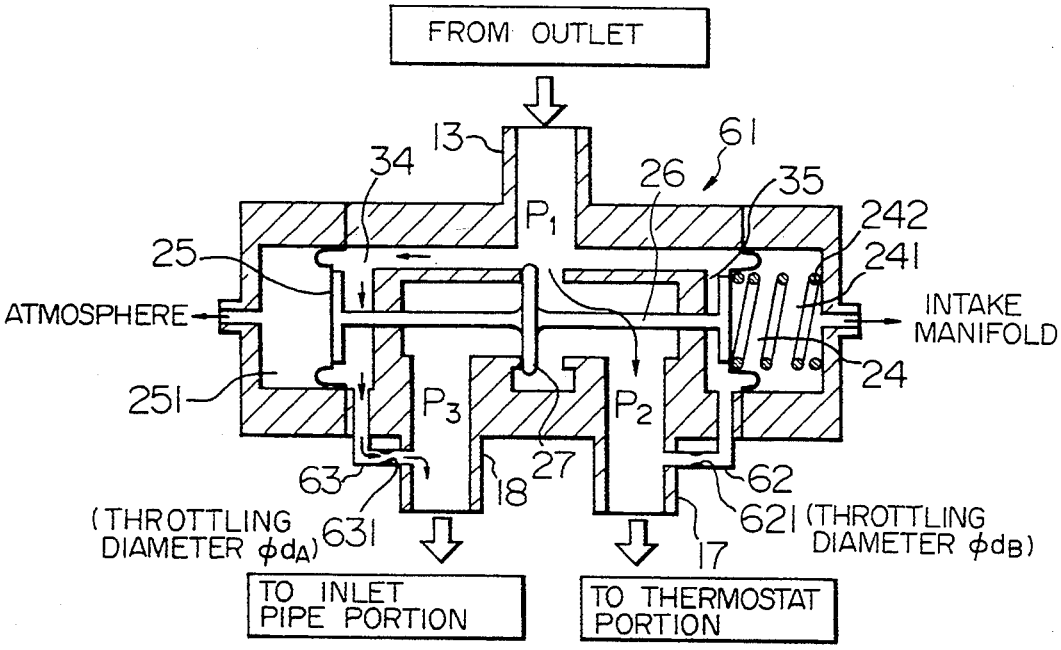
FIGS. 14A and 14B are sectional views showing essential portions of a modification of the flow rate control valve.
Figure 14B:
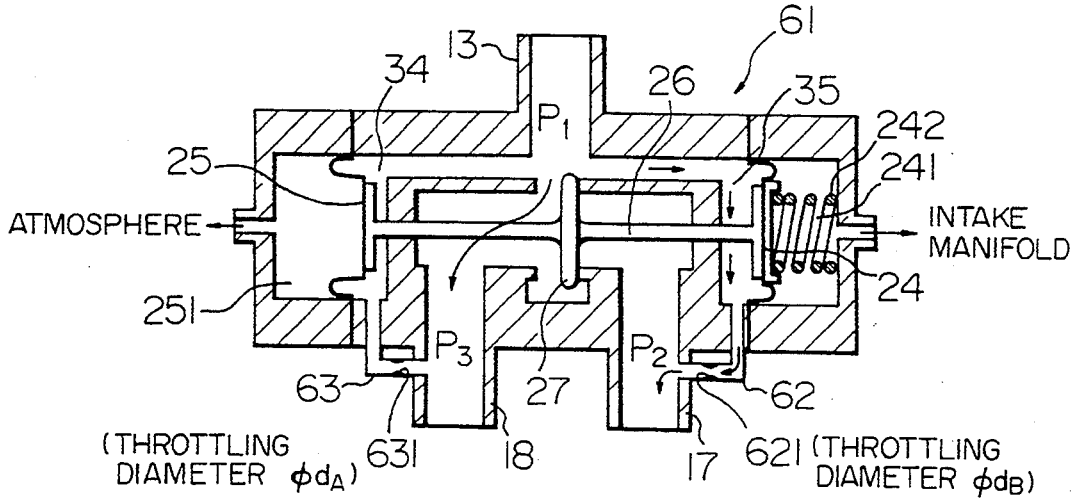

Further, a modification of the above flow rate regulating valve 23 of FIG. 3 is shown in FIGS. 14A and 14B. It is noted that the same component parts as those of the flow rate regulating valve 23 of FIG. 3 are designated by the same reference numerals and description thereof will be omitted.

In a flow rate regulating valve 61 shown in FIGS. 14A and 14B, reference numerals 62, 63 denote water pressure reduction ports. These water pressure reduction ports 62, 63 correspond to the throttle passages 32, 33 and the gaps 36, 37 of the flow rate regulating valve 23 of FIG. 3, and the cooling water coming from the bypass flow passage 13 flows into these ports. In the flow rate regulating valve 23 of FIG. 3, the cooling water in the diaphragm adjoining chambers 34, 35 is made to flow into the first and second passages 17, 18 through the gaps 36, 37. However, in the flow rate regulating valve 61 of the present embodiment, the water pressure reduction ports 62, 63 are formed in the side walls of the diaphragm adjoining chambers 34, 35 so as to communicate the diaphragm adjoining chambers 34, 35 with the first and second passages 17, 18, while reducing the size of the gaps 36, 37 to a minimum which is required to allow the shaft 26 only to slide therein. In the flow rate regulating valve 23 shown in FIG. 3, the shaft 26 is unsteady because of the gaps 36, 37 provided around the shaft 26 so that there is a possibility that a perfect seal with the valve body 27 cannot be made. However, the flow rate regulating valve 61 of the present embodiment does not suffer from such a disadvantage. Incidentally, reference numerals 621, 631 denote throttles.

Figure 15:
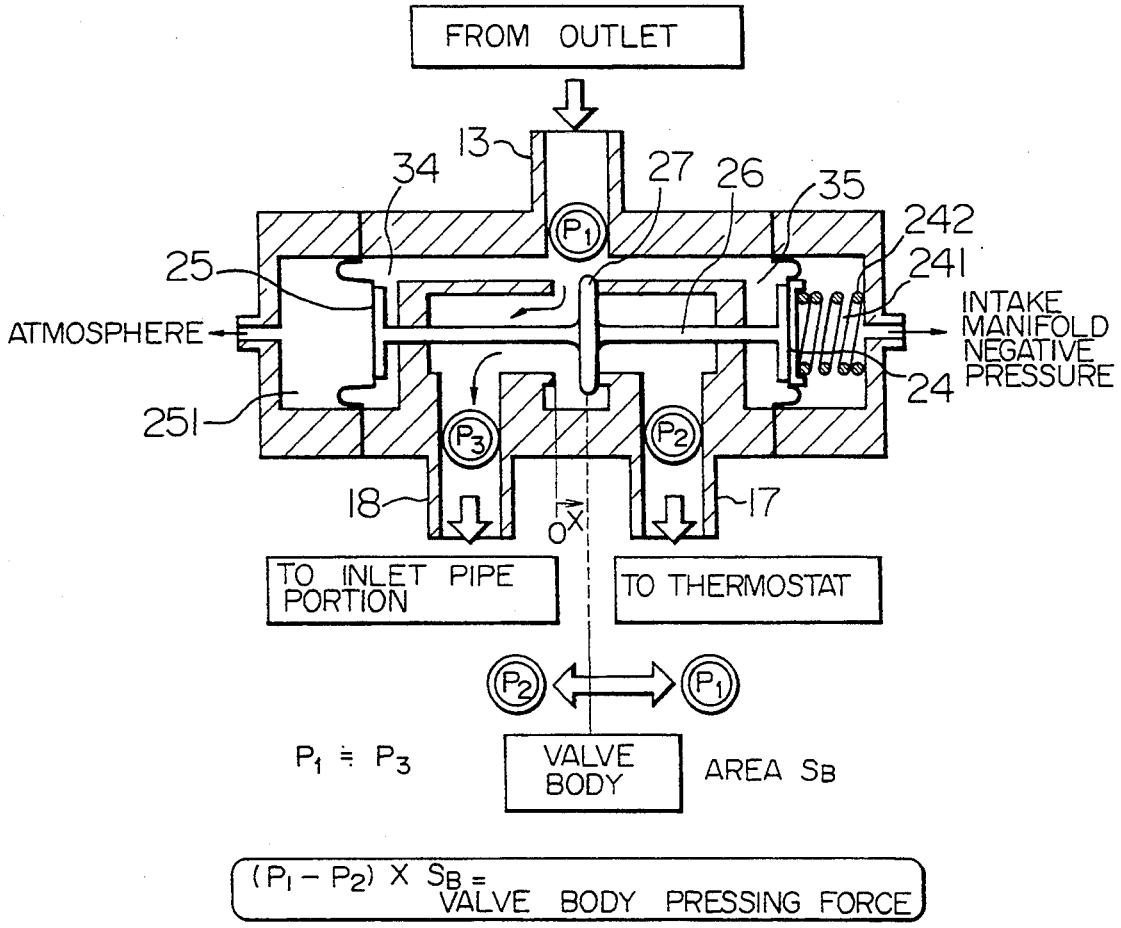
FIG. 15 is an illustration showing the flow rate control valve.

FIG. 15 shows a modification of the flow rate regulating valves 23, 61 of FIGS. 3, 14A and 14B, in which the size of the gaps 36, 37 is minimized and any component part corresponding to the water pressure reduction ports 62, 63 is not provided.

Figure 16:
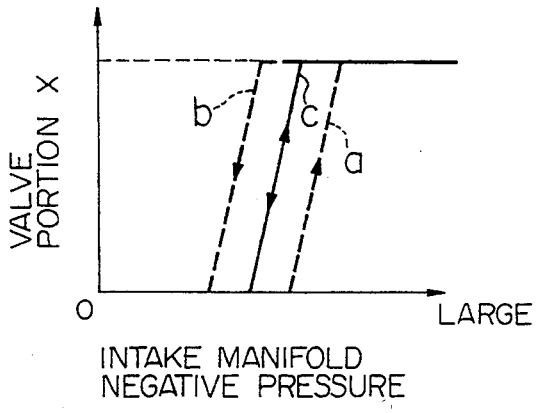
FIG. 16 is a graph showing the relation between the intake manifold negative pressure and the valve position.
Figure 17:
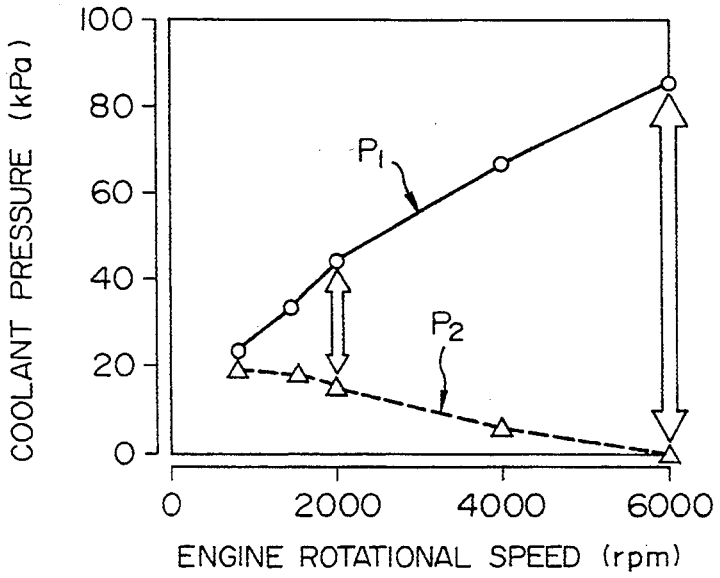
FIG. 17 is a graph showing the relation between the engine rotational frequency and the water pressure.

With the arrangement shown in FIG. 15, hysteresis appears more or less in forward and backward movements as shown by broken lines a and b in FIG. 16, and the hysteresis becomes greater as the rotational frequency of the engine is increased. For example, when the negative pressure of the intake manifold is sufficiently large, the valve body is drawn to its right limit position as shown in FIG. 15 so that all of the water is so controlled as to flow from the outlet toward the inlet pipe portion. In this case, water pressures $P_1$ and $P_3$ become substantially equal to each other but a water pressure $P_2$ becomes lower as compared with the water pressure $P_1$ since water doesn't flow at all to the thermostat. For this reason, assuming that the area of the valve body 27 is $S_B$, a valve body pressing force of $(P_1-P_2)\times S_B$ is exerted on the valve body 27. The results of actual measurement of the water pressures $P_1$ and $P_2$ are shown in FIG. 17. As seen from this drawing, $(P_1-P_2)$ increases in proportion to the rotational frequency as the rotational frequency is increased, and accordingly, the pressing force applied to the valve body 27 is also increased in proportion to the rotational frequency.

When the negative pressure of the intake manifold is lowered, the valve body is caused to move from the position of FIG. 15 which traces a line b shifted to the left from the line c and the amount of such shifting is increased in proportion to the rotational frequency. The line c represents the movement obtained on the assumption that the valve body pressing force is not required. Line c represents no hysteresis appearing in both forward and backward movements.

Figure 18:
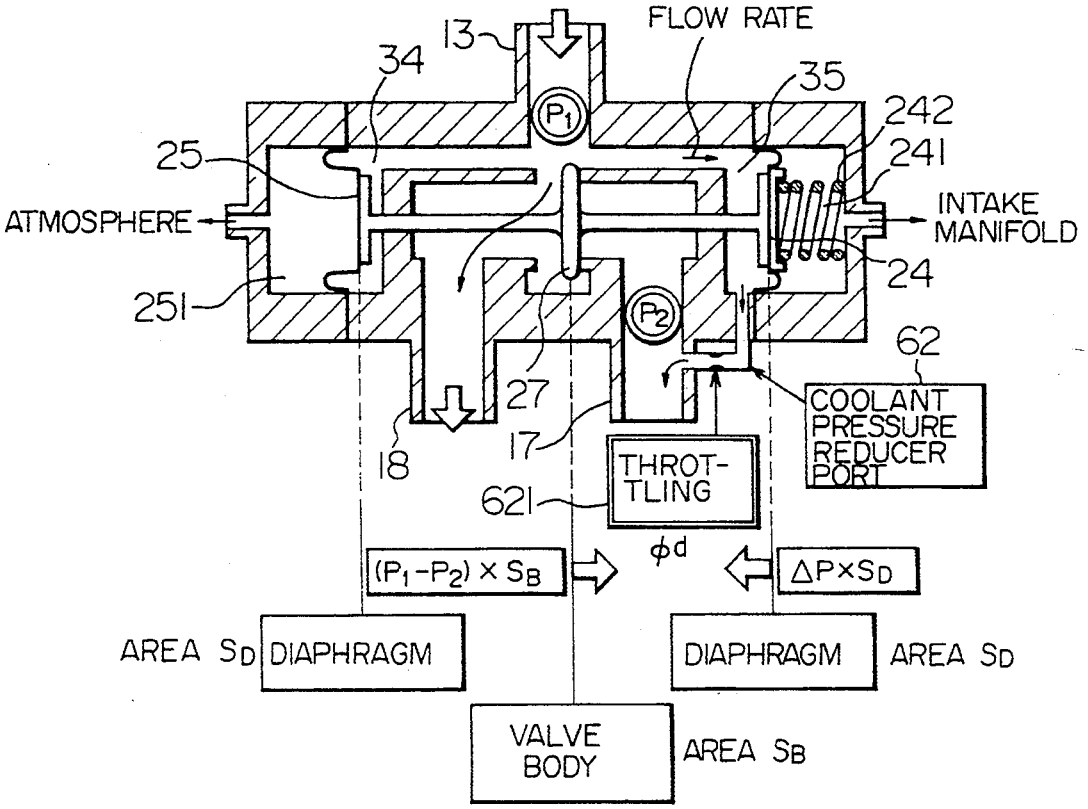
FIG. 18 is an illustration showing the flow rate control valve.

Meanwhile, when the negative pressure of the intake manifold is small and hence the valve body 27 is held in its left limit position contrary to the above case, the water pressures P1 and P2 become substantially equal to each other but the water pressure P3 becomes lower as compared with the water pressure P1, and accordingly, a valve body pressing force of $(P_1-P_3)\times S_B$ is exerted to the valve body 27. When the negative pressure of the intake manifold is lowered, the valve body is caused to move from the left limit position such as to trace line a in FIG. 16, and the amount of such shifting is increased in proportion to the rotational frequency. However, in the flow rate regulating valves 23, 61 shown in FIGS. 3, 14A and 14B which have been described in the foregoing, owing to the provision of the gaps 36, 37 and the water pressure reduction ports 62, 63, the aforesaid valve body pressing force can be canceled. For the convenience of explanation, description will be given first of a flow rate regulating valve in which only the diaphragm adjoining chamber 35 is formed with the water pressure reduction port 62 as shown in FIG. 18. With the arrangement of FIG. 18, the valve body pressing force applied to the valve body held in the position shown in FIG. 15 can be canceled and it is possible in FIG. 16 to make the line b coincide with the line c regardless of the rotational frequency. Namely, by forming the water pressure reduction port 62 in the diaphragm adjoining chamber 35, water of a very small flow quantity q which is proportional to the root of a difference (P1−P2) between the water pressures P and P2 is allowed to flow through the diaphragm adjoining chamber 35. Whereupon, the pressure in the diaphragm adjoining chamber 35 is reduced by AP as compared with the pressure in the diaphragm adjoining chamber 34 and, assuming that the area of the diaphragm is $S_D$, a valve body restoring force expressed by $A_P \times S_D$ is exerted in a direction reverse to the direction of the aforesaid valve body pressing force $(P_1-P_2)\times S_B$. The pressure decrement AP is proportional to the square number of the very small flow quantity q, the very small flow quantity q is proportional to $d^2\times(P_1-P_2)$ assuming that the throttle diameter is fd, and the difference $(P_1-P_2)$ is proportional to the rotational frequency Ne, and accordingly, the relation between the pressure decrement AP and the rotational frequency Ne is expressed as AP a Ne. After all, the magnitudes of the valve body pressing force $(P_1-P_2)\times S_B$ and the valve body restoring force $AP\times S_D$ are proportional to each other. In consequence, by selecting the throttle diameter Xd such as to equalize the magnitudes of the valve body pressing force and of the valve body restoring force to each other, it is possible to cancel the valve body pressing force and, accordingly, it is possible in FIG. 16 to make the line b coincide with the line c irrespective of the rotational frequency.

It goes without saying that, according to this method, it is possible not only to make the line b coincide with the line c but also to provide a means for shifting the line b to the right in FIG. 16 and, as the occasion arises, to set freely the amount of shifting to the right. For example, by shifting the line b to the right beyond the line c, the valve body can be made to move when the negative pressure of the intake manifold is greater than that shown by the line c at the time of high rotational frequency.

On the other hand, in order to shift the line a to the left in FIG. 16, by forming a similar water pressure reduction port in the diaphragm adjoining chamber 34, it is possible to set freely the amount of shifting by which the line a is shifted to the left for the same reasons as described above.

FIG. 14A shows a state in that the negative pressure of the intake manifold is sufficiently small and hence the valve body 27 is held in its left limit position. Since the major part of water flows from the outlet to the thermostat portion, the water pressures P and P2 become substantially equal to each other and, accordingly, water hardly flows through the water pressure reduction port 62. For this reason, the water pressure in the diaphragm adjoining chamber 35 becomes nearly the water pressure P1. However, since water of a very small flow quantity q which is proportional to $d^2\times(P_1-P_2)$ is allowed to flow through the water pressure reduction port 63, the water pressure in the diaphragm adjoining chamber 34 is reduced by APA as compared with the water pressure in the diaphragm adjoining chamber 35, and accordingly, a valve body restoring force of $APA\times SD$ is exerted in the rightward direction against the valve body pressing force $(P_1\ P_3)\times S_B$. As a result, it is possible to shift the line a to the left in FIG. 16.

Meanwhile, when the negative pressure of the intake manifold is sufficiently large and the valve body 27 is held in the position shown in FIG. 14B, water is not allowed to flow through the water pressure reduction port 63 but water of a very small flow quantity qB which is proportional to dB2v' $(P_1-P_2)$ is allowed to flow through the water pressure reduction port 62 contrary to the case of FIG. 14A. Accordingly, the water pressure in the diaphragm adjoining chamber 35 is reduced by APB as compared with the water pressure in the diaphragm adjoining chamber 34 so that a valve body restoring force of $APB\times SD$ is exerted in the leftward direction against the valve body pressing force $(P_1-P_2)\times S_B$. As a result, it is possible to shift the line b to the right in FIG. 16.

Consequentially, it goes without saying that, by suitably selecting the throttle diameter fda or fdB, it is possible to set the characteristic shown in FIG. 16 such as not only to trace the line c with no hysteresis but also trace an arbitrarily chosen line with a desired hysteresis as the occasion demands.

Figure 11:
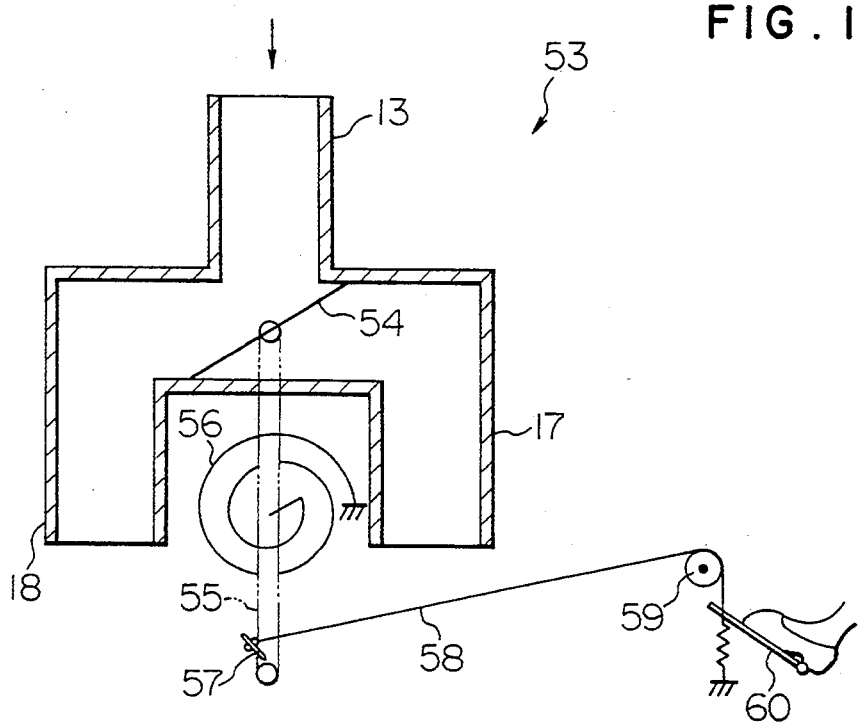
FIG. 11 is an illustration showing another modification of the flow rate regulating valve.

Moreover, another modification of the flow rate regulating valve is shown in FIG. 11.

In a flow rate regulating valve 53 of FIG. 11, a shaft 55 of a butterfly valve 54 is pressed by a spiral spring 56 so as to be held in the position shown in FIG. 11, so that water is prevented from flowing into the first passage 17 but allowed to flow only into the second passage 18. The shaft 55 is provided with a lever 57 which is connected to an accelerator pedal 60 through a pulley 59 by means of a wire 58.

In the flow rate regulating valve 53, when the accelerator pedal 60 is stepped on so that the load on the engine 11 is increased, the wire 58 serves to make the butterfly valve 54 rotate clockwise, and accordingly, the cooling water starts to flow into the first passage 17 as well. The further the accelerator pedal 60 is depressed, that is, the greater the load is increased, the more the quantity of water flowing into the first passage 17 is increased. With the increase of the quantity of water flowing into the first passage 17, the quantity of water flowing into the second passage 18 is decreased and, in the most extreme position, it is possible to make water flow into the first passage 17 alone. Namely, the ratio of the flow rates in the first and second passages 17, 18 can be changed in accordance with the load and, accordingly, the cooling water temperature can be raised at the time of operation of the engine under a low-load condition but lowered at the time of operation under a high-load condition.

Next, a third embodiment of the present invention will be described with reference to FIG. 4.

The system of this embodiment includes the method of speeding-up the rise of the water temperature during the warming-up of the engine.

Figure 4:
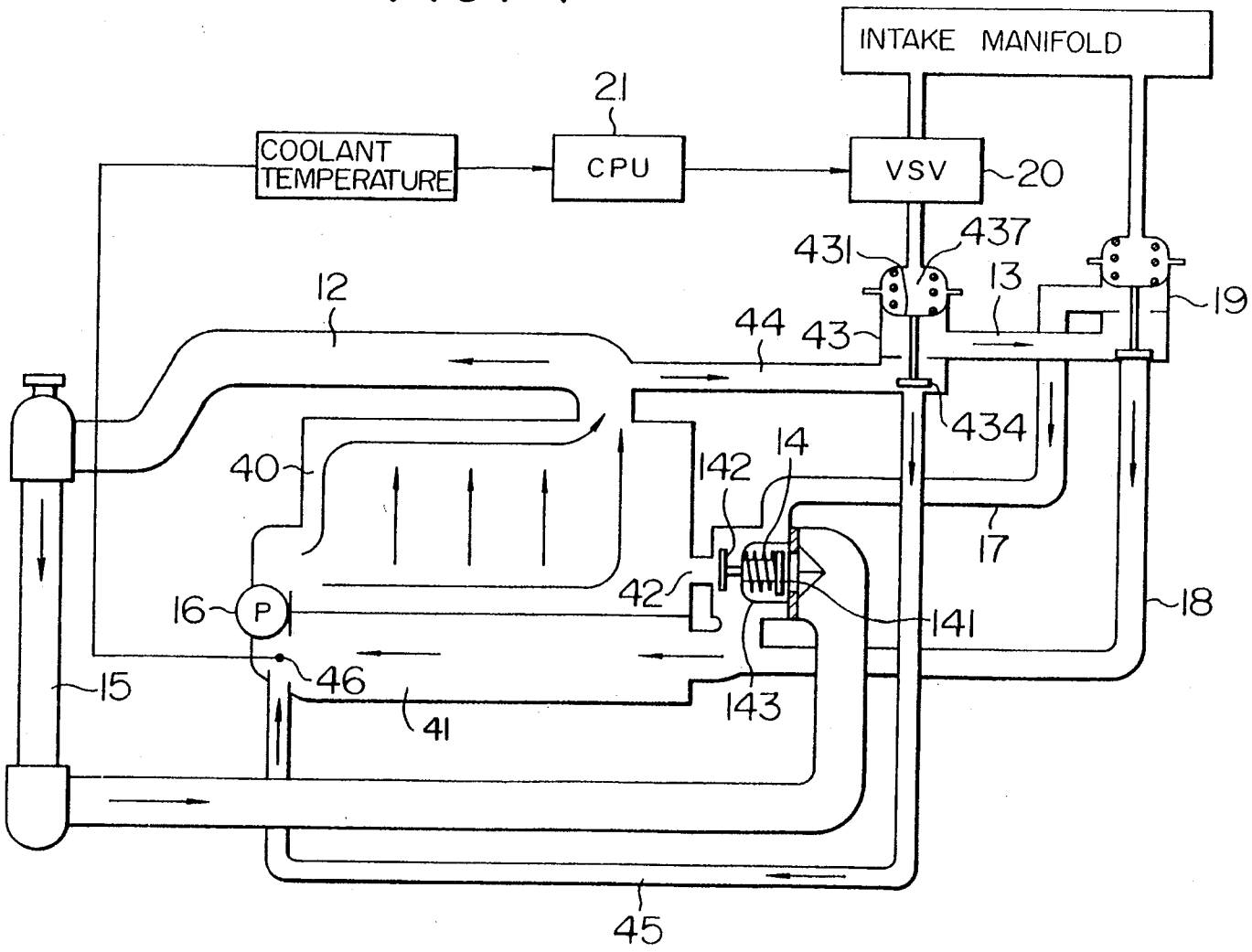
FIG. 4 is a structural view of a cooling system of an internal combustion engine according to a third embodiment of the present invention.

The engine shown in FIG. 4 is an engine 40 of intake side previous cooling type which is provided with an intake side previous cooling passage 41 in an intake-port-side cylinder-head-part of the engine. In the suction side previous cooling system, cooling water of low temperature coming from the outlet of the radiator 15 is first made to flow through the cooling water passage 41 on the intake port side of the cylinder head within the engine 40 (previous cooling passage) and, after being increased in pressure by the pump 16, made to flow through the cooling water passage on the side of the exhaust port of the cylinder block or cylinder head. By so doing, since the cooling water of low temperature coming out from the radiator 15 flows constantly on the intake port side, it is possible to always maintain the intake port at a low temperature, and accordingly, it is possible to increase the output power at the time of the high-load operation particularly after the warming-up of the engine is finished.

On the other hand, during the warming-up of the engine, since a main valve 141 of the thermostat 14 is closed, the cooling water from the radiator 15 is prevented from flowing into the engine 40. In this case, a bypass valve 142 is full opened contrary to the main valve 141 so that the cooling water in the engine 40 is allowed to pass through an internal bypass flow passage 42 and the previous cooling passage 41 and drawn back again by the pump 16 so as to be circulated only within the engine 40, thereby to speed up the rise of the water temperature.

In the present embodiment, in order to further speed up the rise of the water temperature, a changeover valve 43 is employed as shown in FIG. 4. The changeover valve 43 has the same structure as that of the flow rate regulating valve 19. The internal bypass flow passage 42 has a diameter that is large enough to insure that the cooling water of a quantity required for the internal circulation is provided during the warming-up, and the diameter of the internal bypass flow passage 42 of the engine 40 used in the experiment by the present inventor was ∞13 [mm]. Further, a bypass flow passage 44 is provided. It is also possible to provide the bypass flow passage 44 without providing the bypass flow passage 42.

Incidentally, in FIG. 4, the bypass flow passage 44 branches off from the cooling water passage 12. However, it may branch off from anywhere on the discharge side of the pump 16 basically, provided that the cooling water having been used for cooling the engine is not returned into the engine again.

Further, the changeover valve 43 is disposed at an intermediate point of the bypass flow passage 44 so that the negative pressure of the intake manifold is applied to a diaphragm chamber 437 through the VSV 20. When it is decided by the CPU 21 that the water temperature detected by a water temperature sensor 46 disposed on the inlet side of the pump 16 is lower than a specified temperature, the VSV 20 is operated to make the intake manifold and the diaphragm chamber 437 of the changeover valve 43 communicate with each other.

As a result, the negative pressure of the intake manifold is applied to the diaphragm 431 to pull up the valve body 434 so that the cooling water coming from the bypass flow passage 44 is made to flow out through a bypass flow passage 45 to the inlet portion of the pump 16 so as to be drawn by this pump 16. With this arrangement, the flow of cooling water in the previous cooling passage 41 is stagnant.

For this reason, since the temperature of the wall on the suction side is raised, suction air taken into the engine 40 is heated to thereby increase the suction air temperature. As the suction air temperature rises, the cooling heat loss quantity Qw of the engine 40 is increased, and accordingly, it is possible to speed up the rise of the water temperature more quickly.

Figures 5A, 5B, 5C:
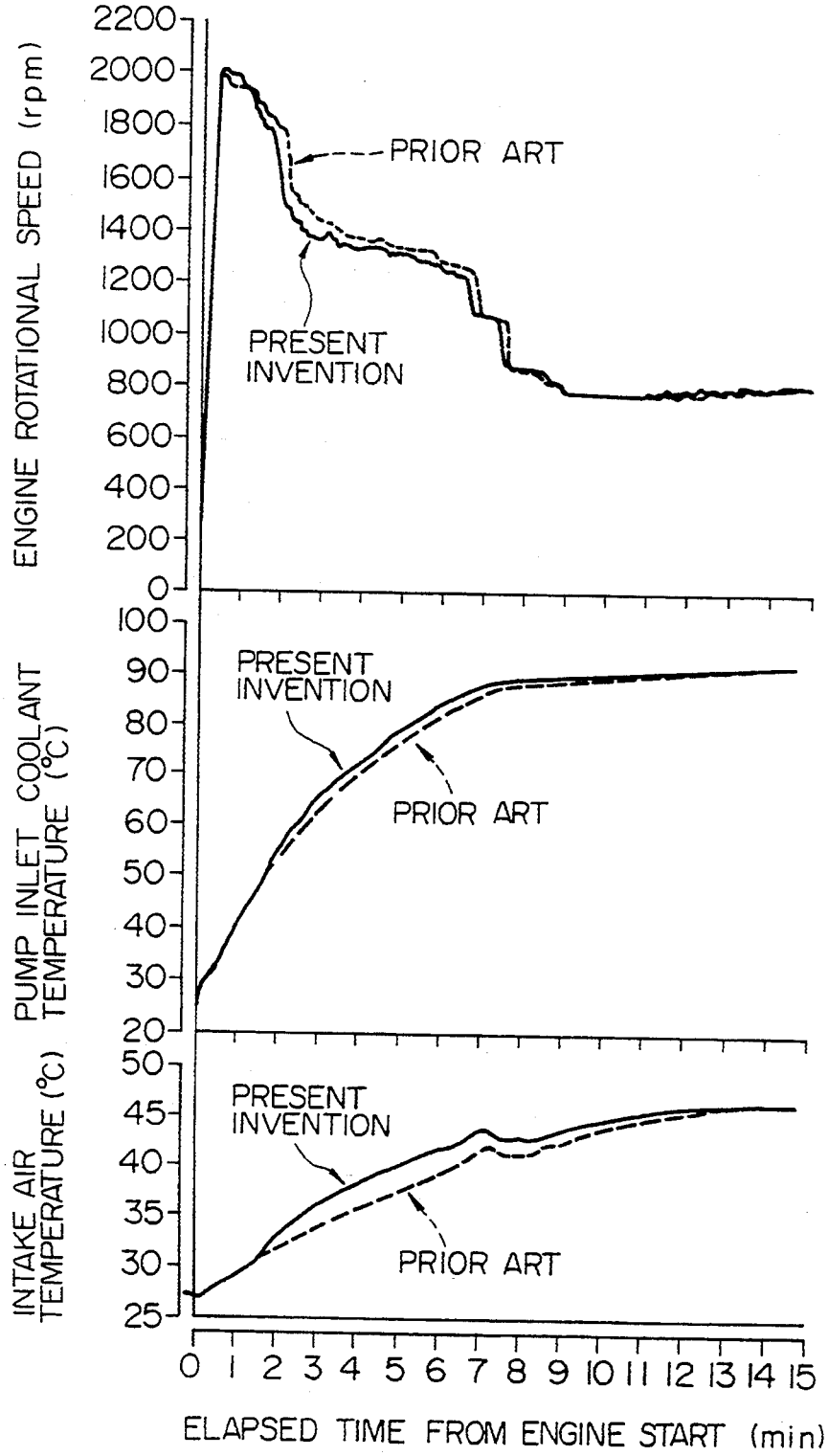
FIG. 5 is a graph showing the experimental results obtained with the use of the third embodiment of the present invention.

FIG. 5 shows the results of the experiment carried out for confirming the rise of the water temperature in the system according to this embodiment of the present invention in which the valve body 434 of the changeover valve 43 of FIG. 4 is pulled up so as to make the cooling water return from the bypass flow passage 44 to the inlet portion of the pump 16 through the bypass flow passage 45 and the diameter of the internal bypass flow passage 42 is set to be +6.5 [mm], in comparison with the water temperature rise in the conventional cooling system in which the changeover valve 43, the flow rate regulating valve 19, the bypass flow passages 44, 45 and 13, and the first and second passages 17 and 18 shown in FIG. 4 are all dispensed with and the diameter of the internal bypass flow passage 42 is set to be f13 [mm]. The running condition is assumed to be suitable for fast idling immediately after the cold starting of the engine. As seen from the results of the experiment, the rotational frequency is high immediately after the starting of the engine 40 but is decreased gradually as the water temperature rises.

With the system of the present invention, a rise in temperature of the suction air can be made faster as compared with the conventional system, thereby making it possible to speed up the rise of the water temperature (water temperature at the pump inlet) as described above. As a result, a decrease of the rotational frequency of the engine can be made faster as well.

Figures 6A, 6B, 6C:
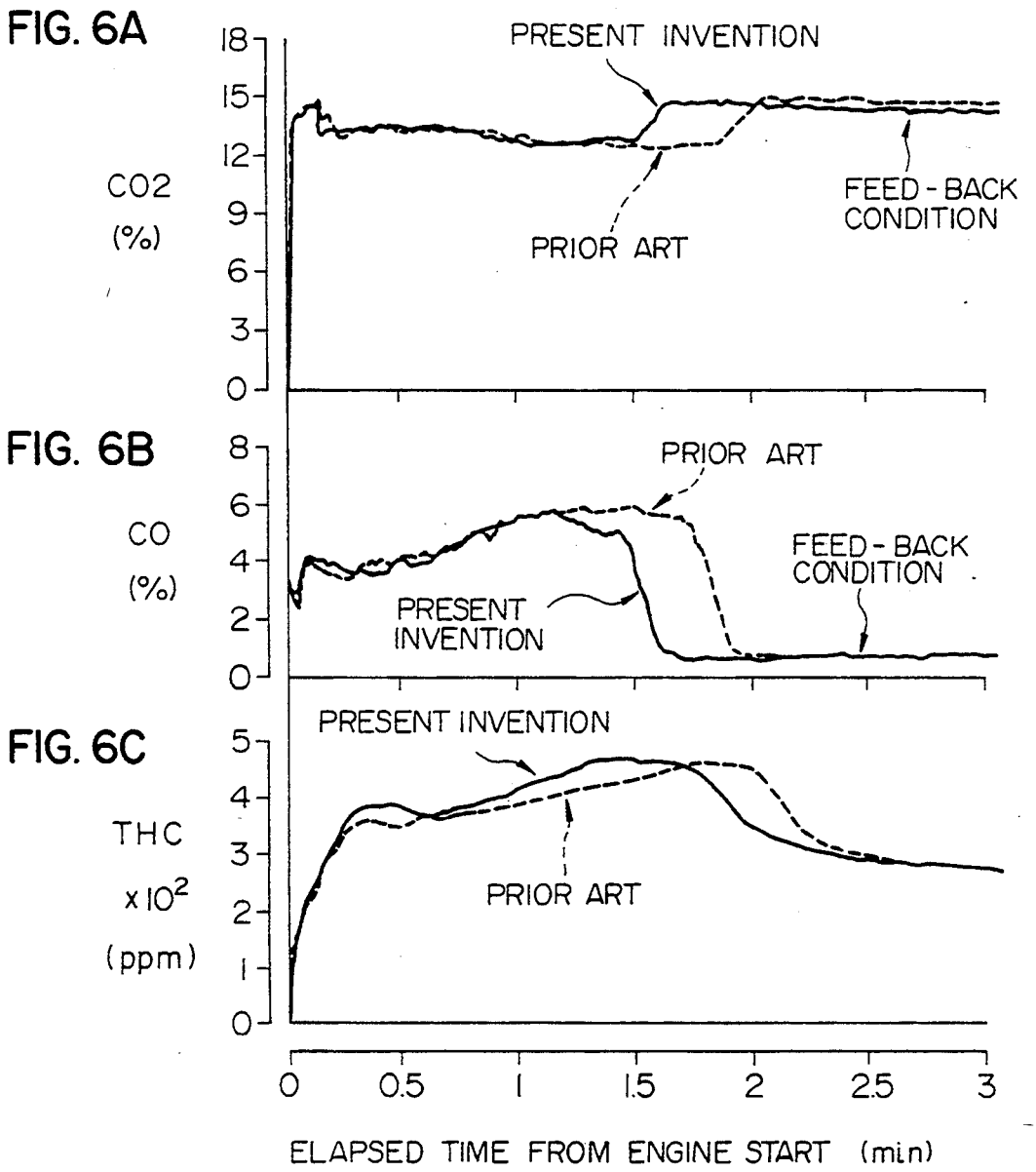
FIG. 6 is a graph showing the experimental results obtained with the use of the third embodiment of the present invention.

FIG. 6 shows the characteristics of emission obtained as a result of the experiment carried out under the same conditions. As seen from FIG. 6, the time when the fast idling is shifted to the feedback running in which the air-fuel ratio A/F is controlled to be 14.5 was advanced by about 20 seconds as compared with the conventional system, thereby making it possible to reduce the emission of CO and THC all the more.

Further, the air-fuel ratio A/F is set so as to supply a rich mixture before the feedback running is started. The time during which such condition is maintained can be shortened and, moreover, the rotational frequency of the engine can be decreased faster as compared with the existing system as shown in FIG. 5, and accordingly, the fuel consumption during the warming-up can be reduced.

Incidentally, in the system shown in FIG. 4, the negative pressure of the intake manifold is applied to the diaphragm chamber 437 during the warming-up so as to control the valve body 434, and however, when the throttle is depressed, that is, when the load is high, the negative pressure of the intake manifold is small so that it does not pull up the valve body 434 in some cases. However, in such high-load running condition, the engine can be warmed up quickly all the time, and accordingly, there is no problem even if the valve body 434 is held in its lowered position.

Moreover, as other embodiments, if the changeover valve 43 is replaced by a valve which can be operated electrically or a valve which is operated by making use of the oil pressure of the engine, it is possible to pull up the valve body 434 constantly when the water temperature is low.

In addition, when the warming-up is finished and the water temperature exceeds the specified temperature, the VSV 20 is operated by the CPU 21 to make the diaphragm chamber 437 communicate with the air. As a result, the valve body 434 is lowered so that the cooling water is allowed to flow into the flow rate regulating valve 19 through the bypass flow passage 13. The flow rate regulating valve 19 is identical with that of the first embodiment shown in FIG. 1 and serves to change the distribution of cooling water to the first and second passages 17 and 18 in accordance with the negative pressure of the intake manifold.

Accordingly, after the warming-up is finished (that is, when the valve body 434 is lowered), it is possible to control the water temperature in the same manner as the first embodiment.

Further, the changeover valve 43 and the flow rate regulating valve 19 of FIG. 4 can be formed to have the structure shown in FIG. 3.

Moreover, description will be given of how to avoid the danger associated with the engine when the water temperature becomes too high with reference to FIG. 8. It is noted that the same component parts as those of the second embodiment are designated by the same reference numerals and explanation thereof will be omitted.

Figure 8:
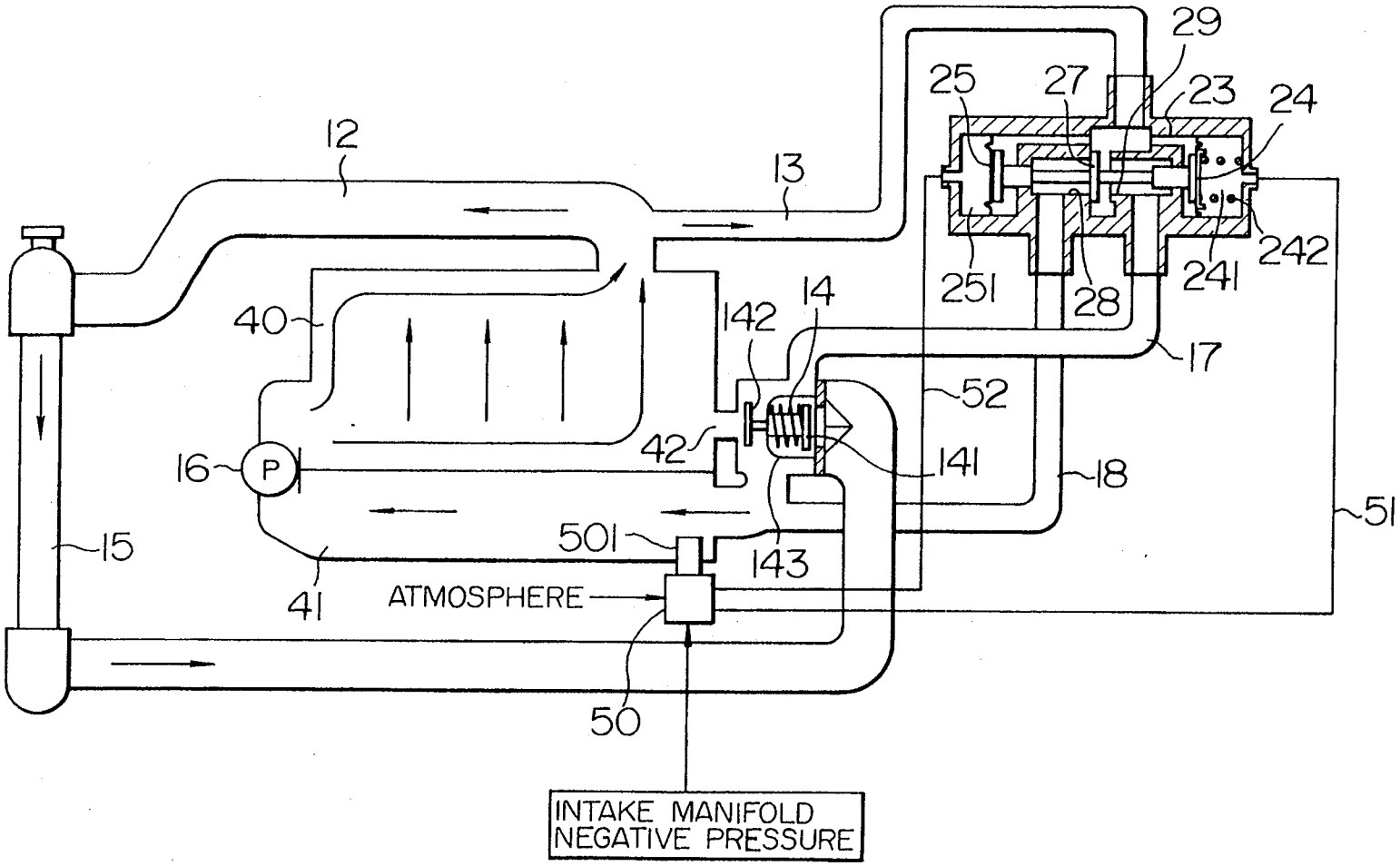
FIG. 8 is a structural view of a cooling system of an internal combustion engine according to a fourth embodiment of the present invention.

In a fourth embodiment shown in FIG. 8, the flow rate regulating valve 23 shown in FIG. 3 is used in place of the flow rate regulating valve 19 of the second embodiment shown in FIG. 2 and a TVSV (thermostatic vacuum switching valve) 50 is used in place of the VSV 20, the CPU 21 and the water temperature sensor 22. It is noted that, in the present embodiment, the engine 40 of suction side previous cooling type is employed. The TVSV 50 is disposed such that a temperature sensing portion 501 thereof is projected into the previous cooling passage 41, so that it serves to detect the temperature of the cooling water flowing through the previous cooling passage 41 and change over the valve in accordance with the temperature detected by the temperature sensing portion 501. Further, the negative pressure of the intake manifold and the air are induced to the TVSV 50.

When the cooling water temperature detected by the temperature sensing portion 501 of the TVSV 50 is not higher than a specified temperature, the negative pressure of the intake manifold is applied to the upper space 241 while the atmospheric pressure is applied to the lower space 251. On the other hand, when the cooling water temperature detected by the temperature sensing portion 501 of the TVSV 50 is higher than the specified temperature, the atmospheric pressure is applied to the upper space 241 while the negative pressure of the intake manifold is applied to the lower space 251.

When the temperature of the cooling water is not higher than the specified temperature, since the negative pressure of the intake manifold is applied to the upper space 241 and the atmospheric pressure is applied to the lower space 251, the diaphragm 24 is controlled by the negative pressure of the intake manifold, and accordingly, the flow rates of cooling water in the first and second passages 17 and 18 are regulated so as to control the cooling water temperature at a suitable temperature.

On the other hand, when the temperature of the cooling water is not lower than the specified temperature, since the negative pressure of the intake manifold is applied to the lower space 251 and the atmospheric pressure is applied to the upper space 241, the valve body 27 is pressed to the left in the drawing owing to the force with which the diaphragm 24 is pressed to the left in the drawing by the spring 242 and the force with which the diaphragm 25 is pulled to the left in the drawing by the negative pressure of the intake manifold applied to the lower space 251. The communication hole 28 is closed by this valve body 27 so that the cooling water is made to flow through the communication hole 29 into the first passage 17. The cooling water flowing through the first passage 17 comes in direct contact with the temperature sensing portion 143 of the thermostat 14. Then, it is detected by the temperature sensing portion 143 of the thermostat 14 that the temperature of the cooling water is higher than the specified temperature, so that the main valve 141 of the thermostat 14 is opened wide to allow the cooling water to flow into the radiator 15 via the engine 40. In consequence, since the cooling water is cooled by the radiator 15, it is possible to decrease the cooling water temperature.

Incidentally, in the present embodiment, the engine 40 of suction side previous cooling type is employed and the heat sensing portion 501 of the TVSV 50 is disposed within the cooling water in the previous cooing passage 41. The engine 40 of this suction side previous cooling type is not limited to this type of engine and in the engine employed in the first and second embodiments, the temperature sensing portion 501 may be disposed within the cooling water which is not used practically for cooling the engine.

Further, in the present embodiment, the temperature of the cooling water flowing through the suction side previous cooling passage 41 is detected. The present invention is not limited in this way, and the temperature of cooling water may be measured anywhere in the cooling water passage system including the cooling water passage 12, the bypass flow passage 13, the first passage 17 and the second passage 18.

Moreover, a BVSV (bimetal vacuum switching valve) may be used in place of the TVSV 50 such that the bimetal portion of this BVSV is disposed in the cooling water passage system. With the use of the BVSV, in accordance with the cooling water temperature detected by the bimetal portion, the negative pressure of the intake manifold and the atmospheric pressure can be changed over similarly to the TVSV 50.

Next, description will be given of a fifth embodiment in which the control of the water temperature is performed with the joint use of a knock control system (KCS) by referring to FIGS. 12 and 13.

Figure 12:
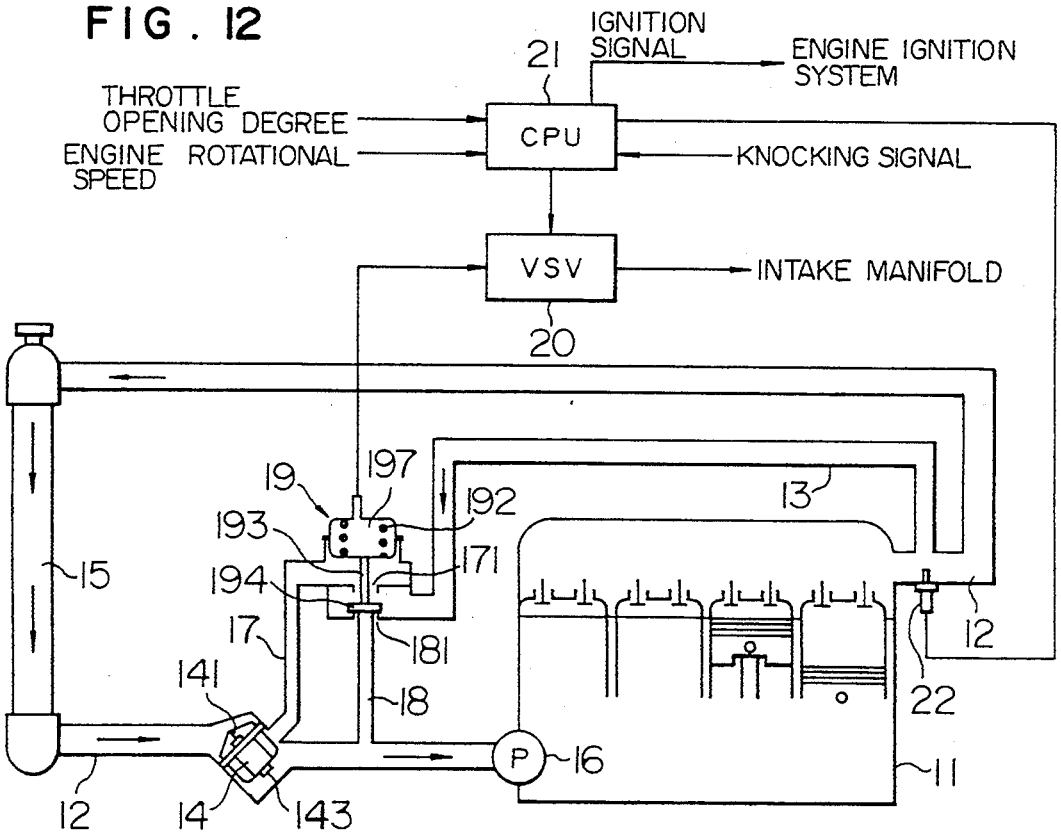
FIG. 12 is a structural view of a fifth embodiment of the present invention.

FIG. 12 shows the arrangement of this embodiment. The arrangement is substantially identical with that of the embodiment shown in FIG. 9, differing in that control logic of the KCS is contained in the CPU 21 so as to provide a function that, upon receiving a knock signal, an arithmetic operation is performed within the CPU 21 to control the ignition timing of the engine to become the trace knock point.

Here, the function of the KCS will be described. The KCS is the system by which the ignition timing is controlled so as to become the trace knock point (close to the limit timing of knock, slight knocking condition or condition immediately before the occurrence of knocking) irrespective of the running conditions of the engine.

However, after all, the KCS serves only to control the ignition timing to become the trace knock point, and the trace knock point is not always most suitable for the fuel consumption and output power of the engine. The most suitable ignition timing for the fuel consumption and output power of the engine is MBT (Minimum Spark Advance for Best Torque, ignition timing immediately before reaching flat shaft torque). When the engine is operated under a high-load condition, knocking usually takes place at a time delayed from the MBT so that it is inevitable to operate at the trace knock point which is delayed from the MBT. Accordingly, if the water temperature is controlled such that the trace knock point approaches the MBT as close as possible, it is possible to improve the fuel consumption and output power of the engine. This control is Performed by the system of FIG. 12.

A controlling method of the CPU 21 used in this system will be described with reference to a flow chart of FIG. 13.

As the control is started at step 100, a throttle opening degree 0 and an engine rotational frequency Ne are read as the engine conditions at step 100. Then, at step 115, it is decided whether or not newly read engine conditions are changed from the engine conditions read last, and, if it is decided YES, the procedure proceeds to step 125 at which a desired water temperature $T_0$ and a desired ignition timing 0ig0 are set. The desired ignition timing 0igo may be so set as to coincide with the aforesaid MBT or may be set at a point delayed from but close to the MBT making allowance for safety.

Thereafter, at step 130, a duty ratio D is calculated in accordance with the desired water temperature $T_0$ and, at the next step 140, the duty ratio D is delivered to the VSV 20.

At step 150, a cooling water temperature T is detected by the water temperature sensor 22. On the other hand, when step 115 results in a NO since the engine conditions are the same as those read last, the process proceeds to step 150.

Figure 10:
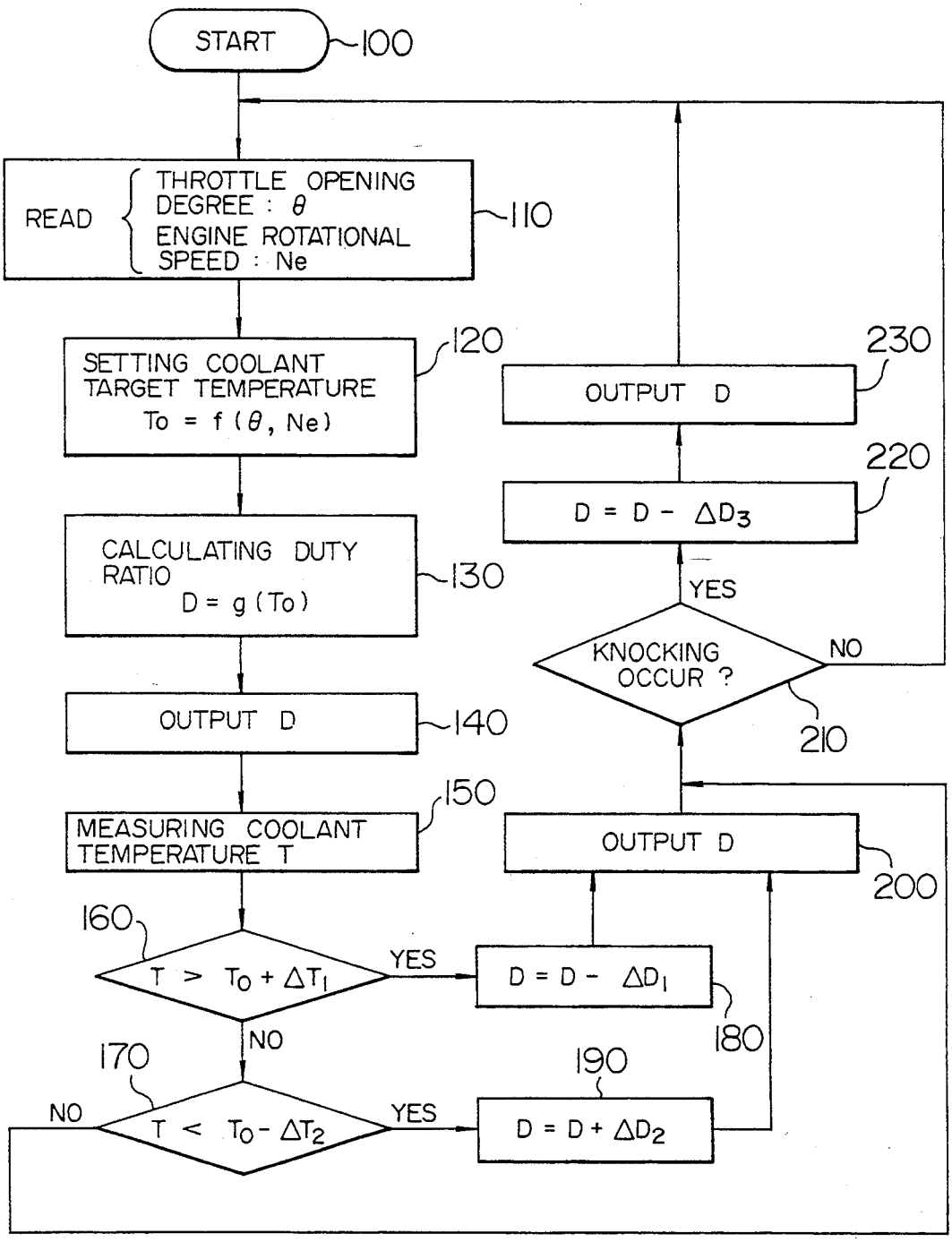
FIG. 10 is a flow chart showing the progress of control in the control unit used in the embodiment shown in FIG. 9.

From step 150 to step 200, the control flow is quite the same as that shown in FIG. 10 and, therefore, description thereof will be omitted. However, at step 170, when it is decided NO, the water temperature T is decided to be controlled to a temperature close to the desired water temperature $T_0$. Then, the process proceeds to step 210. Further, after the duty ratio D is delivered at step 200, the process returns to step 110.

At step 210, an actual ignition timing $\theta ig$ is detected by making use of the method of reading the ignition timing delivered as a result of the arithmetic operation within the KCS or the like. At step 220, the desired water temperature $T_0$ is changed in accordance with the difference ($\theta ig_0-\theta ig$) between the desired ignition timing $\theta ig_0$ and the actual ignition timing 0ig. Here, assuming that the ignition timing $\theta ig$ and the desired ignition timing $\theta ig_0$ are the advancing amounts relative to the standard of TDC, if the difference ($\theta ig_0-\theta ig$) is positive, the actual ignition timing $\theta ig$ is delayed from the desired ignition timing $\theta ig_0$ and, accordingly, it is decided that knocking is likely to occur. As a result, the desired water temperature $T_0$ is lowered. To the contrary, if the difference ($\theta ig_0-\theta ig$) is negative, it is decided that the actual ignition timing $\theta ig$ is too advanced, and accordingly, the desired water temperature $T_0$ is raised. If the difference ($\theta ig_0-\theta ig$) is 0 (zero), the actual ignition timing $\theta ig$ is decided to be as desired, and accordingly, the desired water temperature $T_0$ is not changed.

The arithmetic expression for realizing the above subject includes the following expression, for example.

$$T_0=T_0-K(\theta ig_0-\theta ig) \quad \text{[Expression 1]}$$

where K is a constant.

Further, it is also possible, assuming that difference ($\theta ig_0-\theta ig$) is Aiig, to obtain a changing amount of $\triangle T_0$ of the desired water temperature $T_0$ as shown by an expression 2 described later by making use of a function or a map k and, further, to obtain a desired water temperature $T_0$ utilizing an expression 3 described in the following.

$$\triangle T_0=k(\triangle \theta ig) \quad \text{[Expression 2]}$$

$$T_0=T_0-\triangle T_0 \quad \text{[Expression 3]}$$

Incidentally, if the above subject can be realized, the calculating method thereof is out of the question.

Subsequently, at step 230, a duty ratio D for the new desired water temperature $T_0$ is calculated. At step 240, the duty ratio D calculated is delivered, and thereafter, the procedure returns to step 110.

Figure 13:
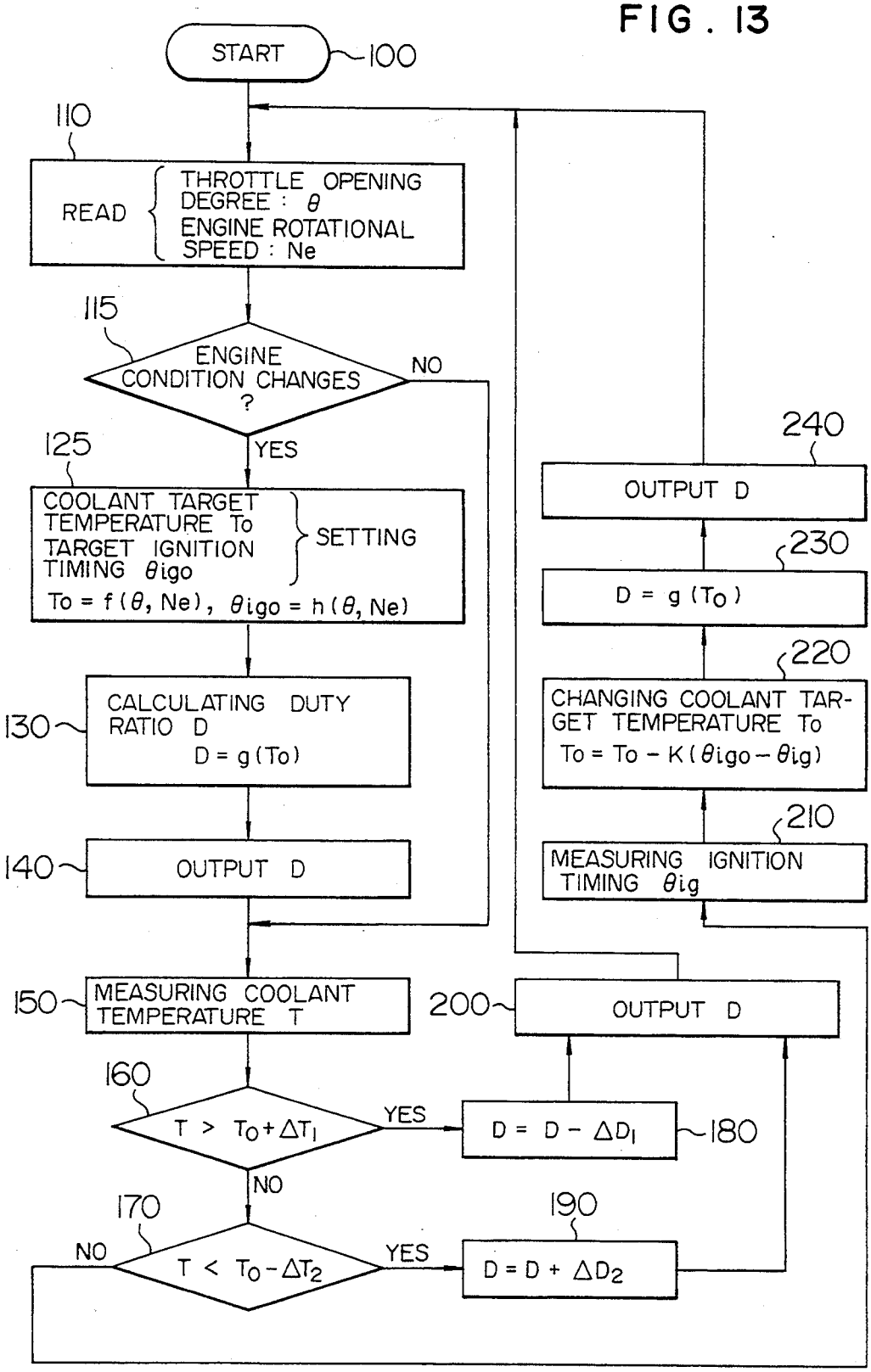
FIG. 13 is a flow chart showing the progress of control in the control unit used in the fifth embodiment of the present invention.

It is noted that it is also possible to equalize the control flow of FIGS. 7 and 10 to that of FIG. 13 by additionally inserting step 115 of FIG. 13 between step 110 and step 120 of FIGS. 7 and 13 so as to control the process in such a way that when it is decided YES in step 115 the process proceeds to step 120 and when it is decided NO the process proceeds to step 150.

As has been described above, according to the cooling system of the internal combustion engine of the present invention, it is possible to obtain an excellent effect in that the temperature of the cooling water flowing into the internal combustion engine can be raised at the time of operation under a low-load condition and lowered at the time of operation under a high-load condition without changing the quantity of water passing through the internal combustion engine.

Figure 19:
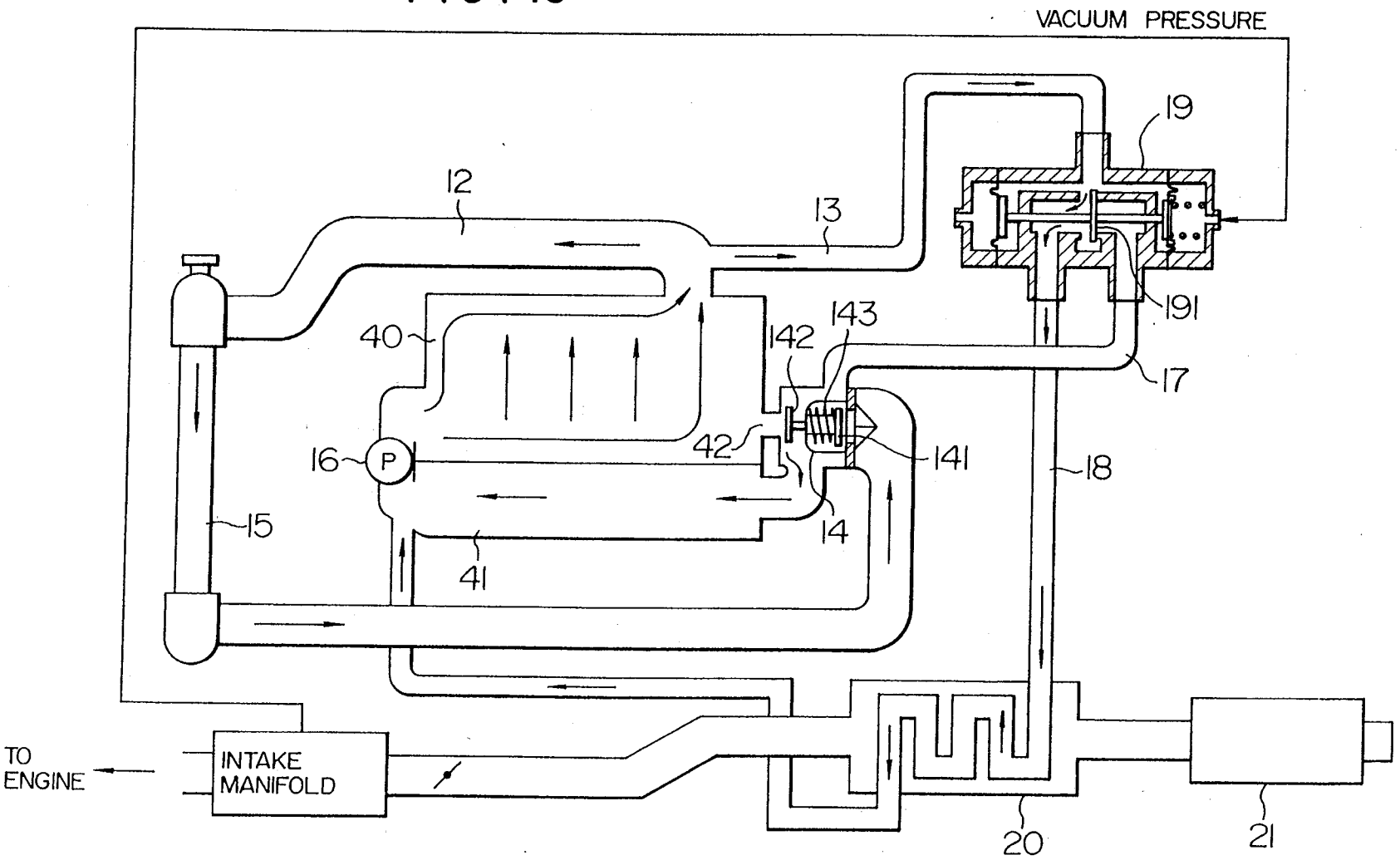
FIG. 19 is a structural view of a cooling system of an internal combustion engine according to the fourth embodiment of the present invention.

In another embodiment of the present invention as shown in FIG. 19, when the load of the engine is small and the vacuum pressure in the intake manifold is large, the valve body 191 of the flow ratio adjusting valve 19 is moved rightward so that a relatively large part of the coolant flows from the bypass 13 through the path 18 to an intake air heater 20 for heating the intake air, and subsequently flows into an inlet of the pump 16 with bypassing the intake air side cylinder head part preferential cooling path 41. Therefore, a coolant flow rate in the preferential cooling path 41 is decreased, and a temperature of the intake air side cylinder head is increased by the combustion energy to heat effectively the intake air, so that the temperature of the intake air is increased to improve a fuel burning efficiency when the load of the engine is small or the engine is warmed up. When the load of the engine is large, the valve body 191 of the flow ratio adjusting valve 19 is moved leftward so that the relatively large part of the coolant flows from the bypass 13 through the path 17 to the thermostat 14 to decrease the temperature of the coolant supplied into the engine. In addition, since the flow rate through the intake air heater 20 is decreased by the coolant flow rate increase through the thermostat 14, the temperature of the intake air is not increased and the intake air of the atmospheric temperature is supplied into the engine.

Figure 20:
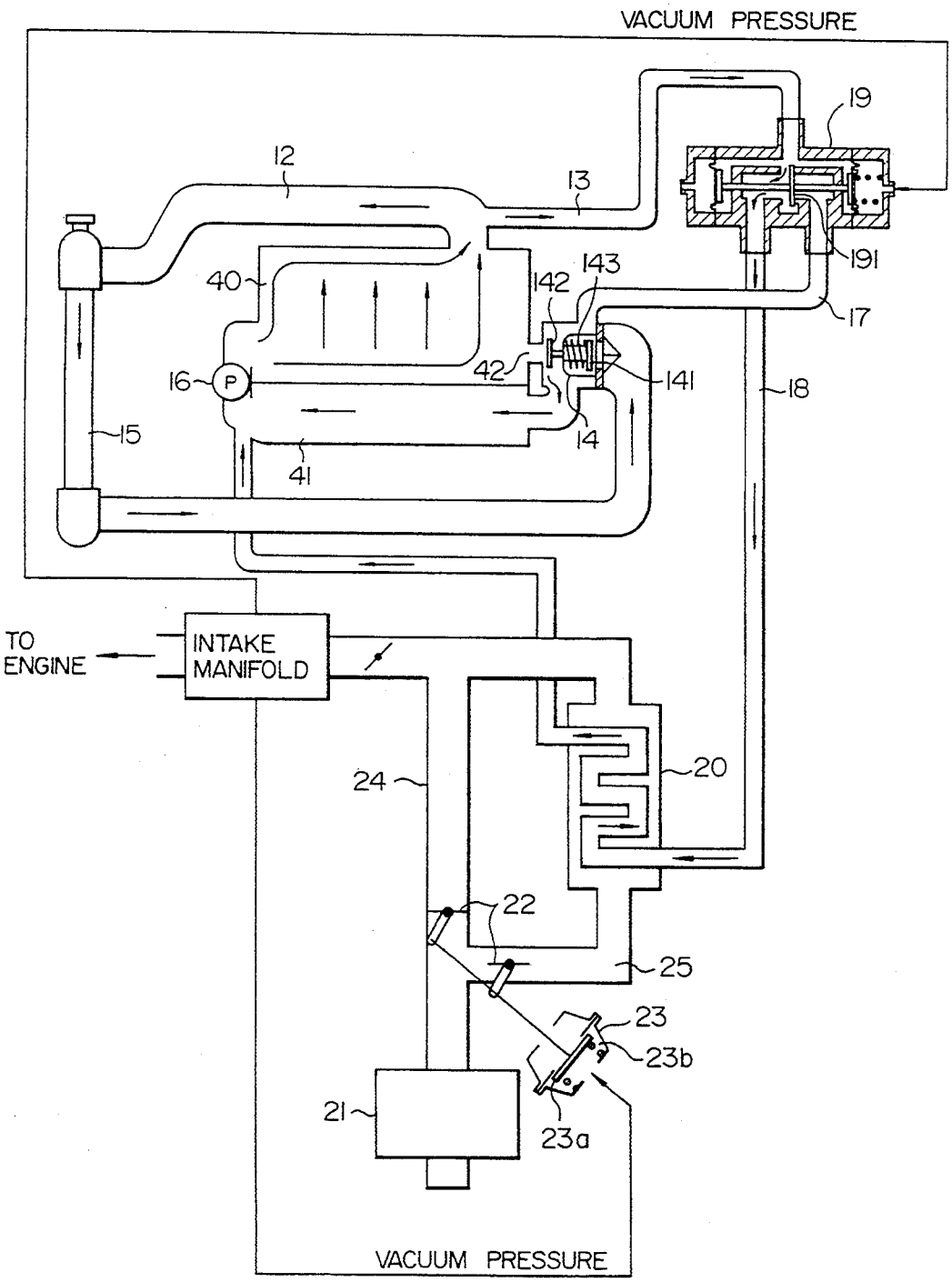
FIG. 20 is a structural view of a cooling system of an internal combustion engine according to the fifth embodiment of the present invention.

In another embodiment of the present invention as shown in FIG. 20, a bypass valve 22 is operated by a diaphragm type actuator 23 which is driven by the vacuum pressure of the manifold so that the intake air temperature is changed more quickly according to the load of the engine in comparison with the embodiment of FIG. 19. When the load of the engine is small and the vacuum pressure is large, a diaphragm 23*a* of the diaphragm type actuator 23 is drawn to operate the bypass valve 22 so that a bypass 24 is closed and a intake air heater path 25 is opened. Therefore, the intake air supplied to the engine is heated by the intake air heater 20. When the load of the engine is large and the vacuum pressure is −47~small, the diaphragm 23*a* of the diaphragm type actuator 23 returns to operate the bypass valve 22 so that the bypass 24 is opened and the intake air heater path 25 is closed. Therefore, the intake air supplied to the engine is not heated by the intake air heater 20 and the intake air of the atmospheric temperature is supplied into the engine.

What is claimed is:

1. A cooling apparatus for cooling an internal combustion engine with coolant passing through the engine, comprising:

a heat exchanger for cooling coolant;

a coolant path for supplying coolant from the engine to the heat exchanger and for returning coolant from the heat exchanger to the engine;

a first bypass arranged in parallel with the coolant path so that coolant from the engine bypasses the heat exchanger and flows into the coolant path at a downstream side of the heat exchanger;

a flow rate control valve arranged at a joint of the first bypass and the coolant path at the downstream side, and adjusting a ratio between a flow rate of coolant through the coolant path and a flow rate of coolant through the first bypass in accordance with a measured temperature of the coolant;

a pump arranged on the coolant path for circulating coolant;

load condition measuring means for measuring a load condition of the engine;

a second bypass diverging from the first bypass and joining the coolant path between the flow rate control valve and the engine; and a flow rate adjusting valve arranged at a joint of the first bypass and the second bypass for making the flow rate of coolant through the first bypass smaller than a flow rate of coolant through the second bypass when the measured load condition is lower than a predetermined load condition and for making the flow rate of coolant through the first bypass larger than the flow rate of coolant through the second bypass when the measured load condition is higher than the predetermined load condition.

2. A cooling apparatus according to claim 1, wherein:

the load condition measuring means measures the load condition from a vacuum pressure in an intake tube for supplying a fuel/air mixture into the engine; and the flow rate adjusting valve adjusts a ratio between the flow rate of coolant through the first bypass and the flow rate of coolant through the second bypass in accordance with the vacuum pressure.

3. A cooling apparatus according to claim 1, further comprising a third bypass for connecting the coolant path at an outlet side of the engine with an intake side of the engine to allow coolant to flow in the third bypass when a temperature of the coolant is not larger than a predetermined temperature.

4. A cooling apparatus according to claim 1, further comprising:

coolant temperature measuring means for measuring a temperature of the coolant;

wherein the flow rate adjusting valve makes the flow rate of coolant through the first bypass larger than the flow rate of coolant through the second bypass when the measured temperature is not lower than a predetermined temperature.

5. A cooling apparatus for cooling an internal combustion engine with coolant passing through the engine, comprising:

heat exchanger means for performing a heat-energy exchange between a first portion of the coolant flowing out from the engine and a cooling fluid, to cool the coolant;

heat exchanger bypass means for preventing a second portion of the coolant flowing out from the engine from flowing into the heat exchanger means, and for returning the second portion of the coolant into the engine with bypassing the heat exchanger means;

coolant combination means for forming a combination coolant flow including both of the first and second portions of the coolant flowing out from the engine;

flow rate ratio adjusting means for adjusting a ratio of first flow rate of the first portion of the coolant flowing out from the engine to a second flow rate of the second portion of the coolant flowing out from the engine in accordance with a temperature of a part of the flow rate ratio adjusting means to which part a heat energy of at least a partial flow of the combination coolant flow is applied, so that the higher the temperature is, the larger the ratio is; and temperature controlling means for controlling the coolant combination means in accordance with a load on the engine so that the larger the load is, the higher the temperature is.

6. A cooling apparatus according to claim 5, further comprising supplemental heat exchanger bypass means for preventing a remainder third portion of the coolant flowing out from the engine from flowing into the heat exchanger means and from flowing into the heat exchanger bypass means and for returning the remainder third portion of the coolant into the engine with bypassing the heat exchanger means and the heat exchanger bypass means.

7. A cooling apparatus according to claim 5, wherein the temperature controlling means controls the temperature of the part of the flow rate ratio adjusting means by changing the second flow rate of the second portion of the coolant.

8. A cooling apparatus according to claim 5, wherein the temperature controlling means measures the load on the engine by sensing a vacuum pressure of an intake air supplied to the engine.

9. A cooling apparatus according to claim 5, further comprising:

supplemental heat exchanger bypass means for preventing a remainder third portion of the coolant flowing out from the engine from flowing into the heat exchanger means and from flowing into the heat exchanger bypass means and for returning the remainder third portion of the coolant into the engine with bypassing the heat exchanger means and the heat exchanger bypass means;

a total amount of flow rates of coolant through the heat exchanger bypass means and the supplemental heat exchanger bypass means is kept substantially constant so that the larger the second flow rate of the second portion of the coolant is, the smaller a flow rate of the remainder third portion of the coolant is.

10. A cooling apparatus according to claim 5, wherein the load on the engine is measured by a sensor which outputs an engine output power instructing signal.

11. A cooling apparatus according to claim 5, wherein the flow rate ratio adjusting means adjusts the ratio by changing the first flow rate of the first portion of the coolant.

12. A cooling apparatus according to claim 5, wherein the temperature controlling means controls the temperature of the part of the flow rate ratio adjusting means with an electric heater.

13. A cooling apparatus according to claim 5, further comprising intake air heating means for heating an intake air for the engine by a heat energy exchange between the intake air and at least a portion of the second portion of the coolant which bypasses the heat exchanger means and flows through the intake air heating means.

14. A cooling apparatus according to claim 5, further comprising an intake-port-side cylinder-head-part bypassing means for allowing at least a fourth portion of the coolant to bypass an intake-port-side cylinder-head-part of the engine so that the intake-port-side cylinder-head-part is restrained from being cooled by the fourth portion of the coolant and an intake air in the intake-port-side cylinder-head-part is heated effectively by a combustion heat energy of the engine when the load on the engine is smaller than a predetermined load.

15. A cooling apparatus according to claim 5, further comprising an intake-port-side cylinder-head-part bypassing means for allowing at least a fourth portion of the coolant to bypass an intake-port-side cylinder-head-part of the engine so that the intake-port-side cylinder-head-part is restrained from being cooled by the fourth portion of the coolant and an intake air in the intake-port-side cylinder-head-part is heated effectively by a combustion heat energy of the engine when a temperature of the fourth portion of the coolant supplied into the engine is smaller than a predetermined temperature.

16. A cooling apparatus according to claim 5, wherein the temperature controlling means increases the temperature when a temperature of the coolant supplied into the engine is higher than a desirable temperature.

17. A cooling apparatus according to claim 5, wherein the temperature controlling means calculates the load on the engine by sensing an engine throttle opening degree and by sensing an engine output rotational speed.

18. A cooling apparatus according to claim 5, wherein the temperature controlling means increases the temperature when a knocking occurs in the engine.

19. A cooling apparatus according to claim 5, wherein the temperature controlling means controls the temperature in accordance with a difference in crankshaft angular position between an actual ignition timing and a desirable ignition timing.

20. A cooling apparatus according to claim 5, further comprising intake air heating means for heating an intake air for the engine by a heat energy exchange between the intake air and at least a portion of the second portion of the coolant which bypasses the heat exchanger means, and flows through the intake air heating means.

* * * * *